US007562745B2

(12) United States Patent
Ishii et al.

(10) Patent No.: US 7,562,745 B2
(45) Date of Patent: Jul. 21, 2009

(54) ELEVATOR WITH AN OPERATION SPACE IN A CENTER OF A MACHINE ROOM

(75) Inventors: Takashi Ishii, Fuchu (JP); Kazuaki Miyakoshi, Fuchu (JP); Shigeru Takaishi, Fuchu (JP); Hiroshi Sano, Shinagawa-ku (JP); Kan Kawasaki, Fuchu (JP); Ikuo Asami, Fuchu (JP); Kazuhiro Izumi, Fuchu (JP); Takanori Urata, Fuchu (JP); Shun Fujimura, Fuchu (JP); Masayuki Higashi, Fuchu (JP); Satoshi Takasawa, Fuchu (JP); Masahiro Kuramitsu, Fuchu (JP)

(73) Assignee: Toshiba Elevator Kabushiki Kaisha, Tokyo-To (JP)

( * ) Notice: Subject to any disclaimer, the term of this patent is extended or adjusted under 35 U.S.C. 154(b) by 168 days.

(21) Appl. No.: 10/548,947

(22) PCT Filed: Jun. 17, 2004

(86) PCT No.: PCT/JP2004/008527

§ 371 (c)(1),
(2), (4) Date: May 30, 2006

(87) PCT Pub. No.: WO2004/113218

PCT Pub. Date: Dec. 29, 2004

(65) Prior Publication Data

US 2007/0175707 A1 Aug. 2, 2007

(30) Foreign Application Priority Data

Jun. 18, 2003 (JP) ..... 2003-173790

(51) Int. Cl.
*B66B 11/08* (2006.01)
*B66B 7/02* (2006.01)
*B66B 11/04* (2006.01)

(52) U.S. Cl. ..... 187/266; 187/254; 187/276; 187/404; 187/406; 187/411

(58) Field of Classification Search ..... 187/254, 187/266, 404, 406, 287, 292, 305, 277, 295, 187/250, 276, 411
See application file for complete search history.

(56) References Cited

U.S. PATENT DOCUMENTS 5,490,577 A * 2/1996 Yoo ..... 187/252
5,533,595 A * 7/1996 Narumi et al. ..... 187/266
5,984,052 A * 11/1999 Cloux et al. ..... 187/404
6,435,314 B1 * 8/2002 Bledsoe et al. ..... 187/292
2005/0178621 A1 8/2005 Kawasaki et al.

FOREIGN PATENT DOCUMENTS

JP 54108331 A * 8/1979
JP 2000-153973 6/2000

(Continued)

OTHER PUBLICATIONS

U.S. Appl. No. 10/548,947, filed Sep. 15, 2005, Ishii, et al.
U.S. Appl. No. 11/597,906, filed Nov. 29, 2006, Kawasaki, et al.

*Primary Examiner*—Peter M Cuomo
*Assistant Examiner*—Stefan Kruer
(74) *Attorney, Agent, or Firm*—Oblon, Spivak, McClelland, Maier & Neustadt, P.C.

(57) ABSTRACT

An elevator in which a driving apparatus, a traction sheave, and a counterweight-side rope hitching portion are arranged above one rail of the right and left cage-side guide rails, while a cage-side rope hitching portion and a speed governor are arranged above the other rail of the right and left cage-side guide rails. Since a control panel is arranged along a rear inner wall surface of the machine room, a large operation space can be secured in a center part of the floor of the machine room. Further, since a machine beam can be extended at full length in the back and forth direction in the machine room, no additional building-side receiving beam is needed.

34 Claims, 18 Drawing Sheets

FOREIGN PATENT DOCUMENTS

| | | | |
|---|---|---|---|
| JP | 2001-48445 | | 2/2001 |
| JP | 2001-72351 | | 3/2001 |
| JP | 2001-187678 | | 7/2001 |
| JP | 2001220078 A | * | 8/2001 |
| JP | 2002-179355 | | 6/2002 |
| JP | 2004-262650 | | 9/2004 |
| WO | WO00/50328 A2 | * | 8/2000 |
| WO | 2004/069718 | | 8/2004 |

* cited by examiner (a)

(b)

ELEVATOR WITH AN OPERATION SPACE IN A CENTER OF A MACHINE ROOM

BACKGROUND OF THE INVENTION

1. Field of the Invention

The present invention relates to an elevator which includes a machine room having only an area equivalent to a horizontal cross-sectional area of an elevator shaft, but in which a large operation space required for a maintenance of an elevator hoist, a control panel, a speed governor, and so on, can be secured, without needing an additional receiving beam on a building side for installing an elevator hoist.

2. Background Art

A machine room is conventionally disposed above an elevator shaft in which a cage and a counterweight of an elevator are vertically moved. An elevator hoist, a control panel, a speed governor, and so on are disposed in the machine room (see Japanese Patent Laid-Open Publication No. 175776/1996 (FIGS. 6 and 7)). For example, in a machine room 1 of a conventional elevator shown in FIG. 25, an elevator hoist 2 is disposed in a center part of the machine room 1, a control panel 3 is disposed along a left wall 1*a*, and a speed governor 4 is disposed along a back wall 1*b*.

A not-shown cage and a counterweight are suspended like a jig back by a main rope 5 passing round a traction sheave 2*a* and a deflecting sheave 2*b* which are driven in rotation by the elevator hoist 2.

A machine bed 6 on which the elevator hoist 2 is mounted is supported by three machine beams 8 which extend horizontally in the right and left direction in the drawing, through rubber cushions 7*a* and 7*b*.

These machine beams 8 are supported by building-side receiving beams 10*a* and 10 which extend perpendicularly to a plane of the drawing, through upward rising machine beams 9*a* and 9*b* (see, for example, Japanese Patent Laid-Open Publication No. 79624/1999 (FIG. 7)).

In the conventional elevator shown in FIG. 25, the elevator hoist 2 is arranged in a center part of the machine room 1 for suspending the cage and the counterweight.

Thus, an operation space required for maintenance of the elevator hoist 2, the control panel 3, the speed governor 4, and so on, is arranged to surround the elevator hoist 2. In this constitution, it is possible to secure a sufficient dimension required for the maintenance operation.

However, the Japanese law relating to buildings and a regulation for ensuring safety of elevators are different from those of foreign countries. Some countries require a unified operation space having a certain minimum area for maintenance carried out in a machine room.

In this case, the arrangement of the operation space which surrounds the elevator hoist 2 does not satisfy safety regulations in such countries. Thus, a machine room having a floor area larger than a horizontal cross-sectional area of an elevator shaft is needed.

On one hand, in the conventional elevator shown in FIG. 25, the control panel 3 must be arranged along an extension of the machine beams 8 because of a layout restriction of the machine room 1.

Thus, it is impossible to elongate ends of the machine beams 8 to a building-side receiving beam 10*c* disposed in a lower part of the left wall 1*a*, so that the receiving beam 10*a* must be additionally disposed on the building side.

On the other hand, as shown in FIG. 26, in order to elongate the ends of the machine beams 8 to the building-side receiving beam 10*c* disposed in a lower part of the left wall 1*a*, the control panel 3 must be mounted on the machine beams 8, and an operation base 11 must be installed to secure an operation space for maintenance of the control panel 3.

In this situation, there may be the case in which a size of the control panel 3 must be limited in a height direction thereof, in order that an upper part of the control panel 3 and a ceiling of the machine room 1 do not interfere with each other.

SUMMARY OF THE INVENTION

An object of the present invention is to provide an elevator which is capable of eliminating the above disadvantage in the conventional art, and includes a machine room having only an area equivalent to a horizontal cross-sectional area of an elevator shaft, but in which a sufficient operation space required for a maintenance of an elevator hoist, a control panel, a speed governor, and so on, can be secured, without needing an additional receiving beam on a building side for installing an elevator hoist.

An exemplary elevator for realizing the above object is an elevator wherein an elevator hoist, a control panel, a speed governor, and a hitching portion of a hoist rope are respectively arranged along an inner surface of a machine room, and a unified operation space for maintaining the equipment is arranged in a center part of the machine room.

That is, in the above exemplary elevator, a unified operation space for maintenance can be arranged in a center part of the machine room. Thus, even the machine room having only a floor area equivalent to a horizontal cross-sectional area of an elevator shaft can satisfy a safety regulation which requires an operation space having a certain minimum area.

Another exemplary elevator is an elevator comprising:

a cage that is guided by a pair of right and left cage-side guide rails to vertically move in an elevator shaft;

a traction sheave that is arranged above one of the pair of right and left cage-side guide rails, and is rotated about a rotational axis extending in the back and forth direction;

a driving apparatus that drives the traction sheave in rotation, and has an axis extending in the back and forth direction:

a counterweight that is guided by a pair of front and rear counterweight-side guide rails below the traction sheave to vertically move in the elevator shaft;

a cage-side sheave disposed on the cage; and a hoist rope that is passed round the traction sheave, and has one end suspending the cage via the cage-side sheave and the other end suspending the counterweight.

In the elevator, a machine room disposed above the elevator shaft includes therein:

a machine beam that extends between building-side receiving beams in the back and forth direction along one of a pair of right and left inner wall surfaces extending opposite to each other in the back and forth direction, the machine beam supporting the driving apparatus, the traction sheave, and a counterweight-side hitching portion for hitching the other end of the hoist rope on a side of the counterweight;

a cage-side hitching portion for hitching the one end of the hoist rope on a side of the cage, and a speed governor, which are arranged along the other of the pair of right and left inner wall surfaces; and a control panel for controlling the driving apparatus, which is arranged along the other inner wall surface, or an inner wall surface extending in the right and left direction between the pair of right and left inner wall surfaces.

That is, in the above exemplary elevator, the driving apparatus, the traction sheave, and the counterweight-side hitching portion can be arranged above one of the pair of right and left cage-side guide rails, while the cage-side hitching portion and the speed governor can be arranged above the other of the right and left cage-side guide rails.

Thus, the driving apparatus, the traction sheave, the counterweight-side hitching portion can be arranged along, for example, the left inner wall surface of the pair of right and left inner wall surfaces of the machine room, while the cage-side hitching portion and the speed governor can be arranged along the right inner wall surface.

The control panel for controlling the driving apparatus and so on can be arranged along the right inner wall surface, a front inner wall surface, or a rear inner-wall surface.

Thus, a unified operation space for maintenance can be arranged in a center part of the machine room. As a result, even the machine room having only a floor area equivalent to a horizontal cross-sectional area of an elevator shaft can satisfy a safety regulation which requires an operation space having a certain minimum area.

In addition, the machine beam supporting the driving apparatus, the traction sheave, and the counterweight-side hitching portion can be extended along the right inner wall surface between the building-side receiving beams in the back and forth direction, without being disturbed by the cage-side hitching portion, the speed governor, and the control panel. Thus, no additional machine beam is needed to support the machine beam.

In another aspect, in an exemplary elevator, both of the cage-side hitching portion and the speed governor are spaced apart from the front inner wall surface of the other inner wall surface.

That is, in the above exemplary elevator, a vacant space is obtained in a position adjacent to the front inner surface of the other inner wall surface of the machine room. Thus, for example, a machine room door and the control panel can be arranged in the space.

In another aspect, in an exemplary elevator, the cage-side hitching portion is disposed on a supporting beam extending along the other inner wall surface between the building-side receiving beams in the back and forth direction.

That is, in the above exemplary elevator, the cage-side hitching portion can be tightly supported by the supporting beam extending in the back and forth direction to be passed between the pair of building-side receiving beams extending along the front and rear edges of the machine room in the right and left direction.

In another aspect, in an exemplary elevator, the cage-side hitching portion is disposed on a supporting beam extending in the right and left direction from the building-side receiving beams extending along the other inner wall surface in the back and forth direction to the machine beam.

That is, in the above exemplary elevator, the cage-side hitching portion can be tightly supported by the supporting beam extending in the right and left direction to be passed between one of the pair of building-side receiving beams extending along the front and rear edges of the machine room in the back and forth direction and the machine beam.

In another aspect, in an exemplary elevator, the speed governor is disposed on a position higher than the cage-side hitching portion.

That is, in the above exemplary elevator, the cage-side hitching portion and the speed governor are arranged adjacent to each other. However, since the speed governor is disposed on a position higher than the cage-side hitching portion, maintenance of the speed governor can be carried out without being disturbed by the cage-side hitching portion.

In another aspect, in an exemplary elevator, the control panel is arranged on a position where the control panel is not interfered with by the supporting beam.

That is, in the above exemplary elevator, the cage-side hitching portion is disposed on the supporting beam. However, since the control panel is arranged on a position where the control panel is not interfered with by the supporting beam, maintenance of the control panel can be carried out without being disturbed by the supporting beam.

In another aspect, in an exemplary elevator, the control panel is mounted on the supporting beam.

That is, in the above exemplary elevator, the cage-side hitching portion is disposed on the supporting beam. However, since the control panel is mounted on the supporting beam, maintenance of the control panel can be carried out without being disturbed by the supporting beam.

In another aspect, in an exemplary elevator, the cage-side sheave is composed of a pair of right and left cage-side sheaves that are respectively arranged near right and left sidewalls of the cage.

That is, in the above exemplary elevator, since the pair of right and left cage-side sheaves can be spaced apart from each other as much as possible in the right and left direction, a gap between the traction sheave and the cage-side hitching portion is enlarged in the right and left direction, so that a large operation space can be obtained in the machine room.

In another aspect, in an exemplary elevator, the traction sheave is arranged such that at least a part of the traction sheave is overlapped with the cage when viewed vertically from above.

That is, in the above exemplary elevator, the cage-side sheave can be arranged directly below one of the right or left sides of the traction sheave. In addition, the counterweight is arranged directly below one of the right or left sides of the traction sheave.

Thus, since a winding angle of the hoist rope with respect to the traction sheave can be made to be 180° or more, a traction performance is secured so that a driving-up force can be securely transmitted from the traction sheave to the hoist rope.

In another aspect, in an exemplary elevator, the driving apparatus has an axial dimension larger than a contour dimension thereof.

That is, when the hoist rope composed of a plurality of ropes of a smaller diameter each having an outer diameter of 4 mm to 6 mm is employed, respective outer diameters of the cage-side sheave and the traction sheave can be restrained to be small. Thus, a degree of freedom of an arrangement of the respective sheaves can be enhanced.

A smaller outer diameter of the traction sheave allows a use of a direct driving motor as a driving apparatus. The direct driving motor has a smaller diameter and a longer axis, and rotates at a high speed.

Thus, since a space occupied by the driving apparatus in the right and left direction in the machine room can be reduced, an operation space in the machine room can be enlarged in the right and left direction.

Another exemplary elevator for realizing the above object, comprises:

an elevator shaft in which a cage and a counterweight that are suspended by a hoist rope like a jig back are vertically moved;

a machine room that has a floor area equivalent to a cross-sectional area of the elevator shaft, and is arranged above the elevator shaft;

an elevator hoist that is arranged along a first inner wall-surface of inner wall surfaces of the machine room, the first inner wall surface extending above one of right and left sidewalls of the cage in the back and forth direction;

a rope hitching portion for hitching at least one of ends of the hoist rope, and arranged near a second inner wall surface of the inner wall surfaces of the machine room, the second inner wall surface extending above the other of the right and left sidewalls of the cage in the back and forth direction; and a control panel that is arranged along a third inner wall surface or the second inner wall surface of the inner wall surfaces of the machine room, the third inner wall surface extending adjacent to the first inner wall surface in the right and left direction.

That is, in the above exemplary elevator, the elevator hoist, the rope hitching portion, and the control panel can be arranged along the respective inner wall surfaces of the machine room.

Thus, such an elevator can be provided that has only an area equivalent to a horizontal cross-sectional area, but can have a sufficient operation space required for maintenance of an elevator hoist, a control panel, a speed governor, and so on.

In another aspect, in an exemplary elevator, a unified operation space for maintenance is arranged in a center part of the machine room. Thus, even the machine room having only a floor area equivalent to a horizontal cross-sectional area of an elevator shaft can satisfy a safety regulation which requires an operation space having a certain minimum area.

In another aspect, in an exemplary elevator, a first supporting beam extending along the first inner wall surface in the back and forth direction is provided between building-side receiving beams extending along the respective inner wall surfaces of the machine room, and the elevator hoist is supported by the first supporting beam. Thus, the elevator hoist can be tightly supported without needing an additional building-side receiving beam.

In another aspect, in an exemplary elevator, a second supporting beam extending along the second inner wall surface in the back and forth direction is provided between the building-side receiving beams extending along the respective inner wall surfaces of the machine room, and the rope hitching portion is supported by the second supporting beam. Thus, the rope hitching portion can be tightly supported without needing an additional building-side receiving beam.

In another aspect, in an exemplary elevator, a third supporting beam extending along the third inner surface is provided between one of the building-side receiving beams extending along the respective inner wall surfaces of the machine room and the first supporting beam, and the rope hitching portion is supported by the third supporting beam. Thus, the rope hitching portion can be tightly supported without needing an additional building-side receiving beam.

In another aspect, in an exemplary elevator, the control panel is supported by the second supporting beam or the third supporting beam. Thus, the control panel can be tightly supported without needing an additional building-side receiving beam.

On one hand, an elevator recited in claim 19 comprises:

a machine room that has a floor area equivalent to a cross-sectional area of an elevator shaft, and is arranged above the elevator shaft;

a cage that is guided by a pair of right and left cage-side guide rails to vertically move in the elevator shaft;

a counterweight that is guided by a pair of counterweight-side guide rails to vertically move in the elevator shaft on one side of right and left sidewalls of the cage;

a traction sheave that is rotated about a rotational axis extending in the back and forth direction, and is arranged along a first inner wall surface of inner wall surfaces of the machine room, the first inner wall surface extending above the counterweight in the back and forth direction;

a driving apparatus for driving the traction sheave in rotation, and arranged along the first inner wall surface in the machine room such that an axis of the driving apparatus extends in the back and forth direction;

a cage-side sheave disposed on the cage;

a hoist rope that is passed round the traction sheave, and has one end suspending the cage via the cage-side sheave and the other end suspending the counterweight;

a cage-side rope hitching portion for hitching the one end of the hoist rope suspending the cage, and is arranged near a second inner wall surface of the inner wall surfaces of the machine room, the second inner wall surface extending opposite to the first inner wall surface in the back and forth direction; and a control panel for controlling the driving apparatus, and arranged along a third inner wall surface adjacent to the first inner wall surface of the inner wall surfaces of the machine room, or the second inner wall surface.

That is, in the elevator, the driving apparatus, the traction sheave, and the counterweight-side rope hitching portion can be arranged above one of the pair of right and left cage-side guide rails, while the cage-side rope hitching portion and the speed governor can be arranged above the other of the right and left cage-side guide rails.

Thus, the driving apparatus, the traction sheave, and the counterweight-side rope hitching portion can be arranged along, for example, the left inner wall surface of the pair of right and left inner wall surfaces of the machine room, while the cage-side rope hitching portion and the speed governor can be arranged along the right inner wall surface.

The control panel for controlling the driving apparatus and so on can be arranged along the right inner wall surface, a front inner wall surface, or a rear inner wall surface.

Thus, a unified operation space for maintenance can be arranged in a center part of the machine room. As a result, even the machine room having only a floor area equivalent to a horizontal cross-sectional area of an elevator shaft can satisfy a safety regulation which requires an operation space having a certain minimum area.

On the other hand, in another aspect, an exemplary elevator comprises:

a machine room that has a floor area equivalent to a cross-sectional area of an elevator shaft, and is arranged above the elevator shaft;

a cage that is guided by a pair of right and left cage-side guide rails to vertically move in the elevator shaft;

a counterweight that is guided by a pair of counterweight-side guide rails on a side of a rear wall of the cage to vertically move in the elevator shaft;

a traction sheave that is rotated about a rotational axis extending in the back and forth direction, and is arranged along a first inner wall surface of inner wall surfaces of the machine room, the first inner wall surface extending above one of right and left sidewalls of the cage in the back and forth direction;

a driving apparatus for driving the traction sheave in rotation, and arranged along the first inner wall surface in the machine room such that an axis of the driving apparatus extends in the back and forth direction;

a cage-side sheave disposed on the cage;

a deflecting sheave arranged along an inner wall surface of the elevator shaft;

a hoist rope that is passed round the traction sheave, and has one end suspending the cage via the cage-side sheave and the other end extending to the counterweight by being guided by the deflecting sheave to suspend the counterweight;

a cage-side rope hitching portion for hitching the one end of the hoist rope suspending the cage, and arranged near a second inner wall surface of the inner wall surfaces of the machine room, the second inner wall surface extending opposite to the first inner wall surface in the back and forth direction; and a control panel for controlling the driving apparatus, and arranged along a third inner wall surface adjacent to the first inner wall surface of the inner wall surfaces of the machine room, or the second inner wall surface.

That is, in the elevator according to claim 20, the driving apparatus and the traction sheave can be arranged above one of the pair of right and left cage-side guide rails, while the cage-side rope hitching portion, the counterweight-side rope hitching portion, and the speed governor can be arranged above the other of the right and left cage-side guide rails.

Thus, the driving apparatus and the traction sheave can be arranged along, for example, the left inner wall surface of the pair of right and left inner wall surfaces of the machine room, while the cage-side rope hitching portion, the counterweight-side rope hitching portion, and the speed governor can be arranged along the right inner wall surface.

The control panel for controlling the driving apparatus and so on can be arranged along the right inner wall surface, a front inner wall surface, or a rear inner wall surface.

Thus, a unified operation space for maintenance can be arranged in a center part of the machine room. As a result, even the machine room having only a floor area equivalent to a horizontal cross-sectional area of an elevator shaft can satisfy a safety regulation which requires an operation space having a certain minimum area.

In another aspect, in an exemplary elevator, a first supporting beam extending along the first inner wall surface in the back and forth direction is provided between building-side receiving beams arranged along a periphery of the machine room, and the driving apparatus is supported by the first supporting beam. Thus, the driving apparatus can be tightly supported without being disturbed by the cage-side rope hitching portion, the speed governor, and the control panel, and without needing an additional building-side receiving beam.

In another aspect, in an exemplary elevator, the driving apparatus has an axial dimension larger than a contour dimension thereof. Thus, since a space occupied by the driving apparatus in the right and left direction in the machine room can be reduced, an operation space in the machine room can be enlarged in the right and left direction.

When the hoist rope composed of a plurality of ropes of a smaller diameter each having an outer diameter of 4 mm to 6 mm is employed, respective outer diameters of the cage-side sheave and the traction sheave can be restrained to be small. Thus, a degree of freedom of an arrangement of the respective sheaves can be enhanced.

A smaller outer diameter of the traction sheave allows a use of a direct driving motor as a driving apparatus. The direct driving motor has a smaller diameter and a longer axis, and rotates at a high speed.

In another aspect, in an exemplary elevator, the cage-side sheave is composed of a pair of right and left cage-side sheaves that are respectively arranged near right and left sidewalls of the cage. Thus, since the pair of right and left cage-side sheaves can be spaced apart from each other as large as possible in the right and left direction, a gap between the traction sheave and the cage-side hitching portion is enlarged in the right and left direction, so that a large operation space can be obtained in the machine room.

In another aspect, in an exemplary elevator, the traction sheave is arranged such that a part of the traction sheave is overlapped with the cage when viewed vertically from above. Thus, one of the right and left cage-side shaves can be arranged directly below the traction sheave. Thus, since a winding angle of the hoist rope with respect to the traction sheave can be made to be 180° or more, a traction performance is secured so that a driving-up force can be securely transmitted from the traction sheave to the hoist rope.

In another aspect, in an exemplary elevator, the cage-side rope hitching portion is supported by a second supporting beam extending along the second inner wall surface in the back and forth direction between the building-side receiving beams. Thus, the cage-side rope hitching portion can be tightly supported without needing an additional building-side receiving beam.

In another aspect, in an exemplary elevator, the cage-side rope hitching portion is supported by a third supporting beam extending in the right and left direction to be passed between the building-side receiving beams extending along the second inner wall surface in the back and forth direction and the first supporting beam. Thus, the cage-side rope hitching portion can be tightly supported without needing an additional building-side receiving beam.

In another aspect, in an exemplary elevator, the counterweight-side rope hitching portion for hitching the other end of the hoist rope suspending the counterweight is supported by the second supporting beam extending along the second inner wall surface in the back and forth direction between the building-side receiving beams. Thus, the counterweight-side rope hitching portion can be tightly supported without needing an additional building-side receiving beam.

In another aspect, in an exemplary elevator, the control panel is arranged on a position where the control panel is not interfered with by the first to third supporting beams. Thus, maintenance of the control panel can be easily carried out without being disturbed by the supporting beams.

In another aspect, in an exemplary elevator, the control panel is mounted on the first to third supporting beams. Thus, maintenance of the control panel can be easily carried out without being disturbed by the supporting beams. In addition, the control panel can be tightly supported without needing an additional building-side receiving beam.

In another aspect, in an exemplary elevator, a speed governor for controlling a vertical movement speed of the cage is arranged along the second inner wall surface in the machine room. Thus, maintenance of the speed governor can be carried out in an operation space arranged in a center part of the machine room.

In another aspect, in an exemplary elevator, both of the cage-side rope hitching portion and the speed governor are arranged on a front portion of the second inner wall surface. Thus, a vacant space is obtained in a rear part of the second inner wall surface. Thus, a machine room door and the control panel can be arranged in the vacant space.

In another aspect, in an exemplary elevator, the speed governor is disposed on a position higher than the cage-side hitching portion. Thus, maintenance of the speed governor can be easily carried out without being disturbed by the cage-side rope hitching portion.

BRIEF DESCRIPTION OF THE DRAWINGS

FIG. 25(*b*) is a side cross-sectional view of the machine room of the conventional elevator.

DETAILED DESCRIPTION OF THE INVENTION

Respective embodiments of an elevator according to the present invention are hereinafter described in detail with reference to FIGS. 1 to 24.

In the description below, a right and left direction is defined as a direction in which an entrance door of a cage is opened/closed; a back and forth direction is defined as a direction in which passengers enter/exit the cage; and an up and down direction is defined as a vertical direction.

The same parts have the same reference numbers, and their description will be omitted.

First Embodiment

Figure 1:
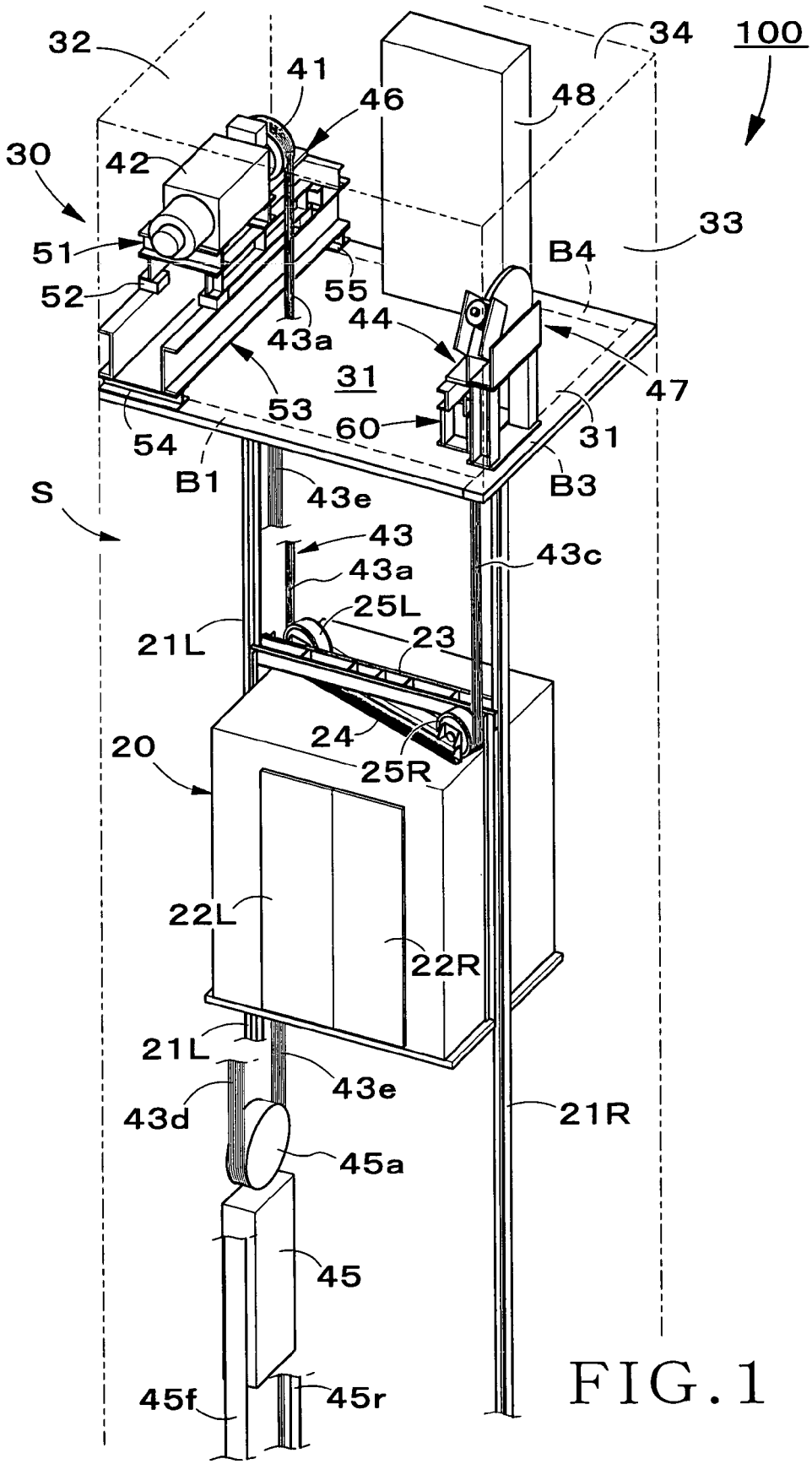
FIG. 1 is a perspective view of an elevator in a first embodiment according to the present invention.

A general structure of an elevator in a first embodiment is described with reference to FIGS. 1 and 2. A cage 20 is guided by a pair of right and left cage-side guide rails 21L and 21R to be vertically moved in an elevator shaft S installed in a building.

A pair of right and left doors 22L and 22R disposed on a front surface of the cage 20 is opened/closed in the right and left direction.

A cage frame supporting the cage 20 includes an upper beam 23 horizontally extending above the cage 20 in the right and left direction, and a sheave supporting beam 24 connected to the upper beam 23 such that an upper surface of the sheave supporting beam 24 is tightly in contact with a longitudinal center part of a lower surface of the upper beam 23, and the sheave supporting beam 24 is inclined both in the back and forth direction and the right and left direction in a horizontal plane relative to the upper beam 23.

A pair of right and left cage-side sheaves 25L and 25R is rotatably supported on right and left ends of the sheave supporting beam 24.

A machine room 30 is disposed above the elevator shaft S in which the cage 20 and a counterweight 45 guided by a pair of front and rear counterweight-side guide rails 45*f* and 45*r* are vertically moved.

On a floor 31 of the machine room above the left cage-side guide rail 21L, a traction sheave 41 which rotates about a rotational axis extending in the back and forth direction, and a driving apparatus 42 for driving the traction sheave 41 in rotation having an axis extending in the back and forth direction are arranged to extend along a left inner wall surface 32.

A hoist rope 43 passing round the traction sheave 41 is composed of a plurality of ropes of a smaller diameter each having an outer diameter of 4 mm to 6 mm. The hoist rope 43 suspends the cage 20 and the counterweight 45 like a jig back in a two-to-one roping arrangement.

The hoist rope 43 includes a part 43*a* pendent from the traction sheave 41 to the cage 20, a part 43*b* horizontally extending between the pair of right and left cage-side sheaves 25L and 25R, and a part 43*c* extending upward from the right cage-side sheave 25R to pass through the floor of the machine room 30, with an upper end of the part 43*c* being hitched on a cage-side rope hitching portion 44 in the machine room 30.

The hoist rope 43 includes a part 43*d* pendent from the traction sheave 41 passing through the floor of the machine room 30 to the counterweight 45, and a part 43*e* passing round the counterweight-side sheave 45*a* rotatably disposed on the counterweight 45 and extending upward to pass through the floor of the machine room 30, with an upper end of the part 43*e* being hitched on a counterweight-side rope hitching portion 46.

Since each of the ropes forming the hoist rope 43 has an outer diameter of as small as 4 mm to 6 mm, outer diameters of the traction sheave 41. the pair of right and left cage-side sheaves 25L and 25R, and the counterweight-side sheave 45*a* can be respectively restrained to be from about 200 mm to about 250 mm.

Thus, a degree of freedom of an arrangement of the respective sheaves is enhanced, which also enhances a degree of freedom of a drawing of the hoist rope 43.

To be specific, an inclination angle of the sheave supporting beam 24 relative to the upper beam 23 can be reduced, while the pair of right and left cage-side sheaves 25L and 25R is sufficiently brought close to the right and left sidewalls 20*a* and 20*b* of the cage 20.

Since a torsion angle of the part 43*a* of the hoist rope 43 extending between the traction sheave 41 and the left cage-side sheave 25L can be restrained to be small, it is possible to prevent a generation of noises and vibrations accompanied with a contact of the respective ropes forming the hoist rope 43 with rope grooves of the respective sheaves.

The left cage-side sheave 25L is arranged to be sufficiently close to the left sidewall 20*a* of the cage 20, with a part of the traction sheave 41 being arranged to overlap with the cage 20 when viewed vertically from above. In addition, the counterweight-side sheave 45*a* is arranged directly below the traction sheave 41.

Such a constitution allows a winding angle of the hoist rope 43 with respect to the traction sheave 41 to be 180 degrees or more, and a traction performance is secured so that a driving-up force can be securely transmitted from the traction sheave 41 to the hoist rope 43.

A layout of the machine room 30 is described with reference to FIGS. 2 to 4. The traction sheave 41, the driving apparatus 42, each having an axis extending in the back and forth direction, and the counterweight-side rope hitching portion 46 are arranged along the left inner wall surface 32 of the pair of right and left inner wall surfaces 32 and 33 which extend opposite to each other in the back and forth direction.

The cage-side rope hitching portion 44 and the speed governor 47 are arranged near the right inner wall surface 33.

The control panel 48 for controlling an operation of the driving apparatus 42 and so on is arranged along a center part in the right and left direction of a rear inner wall surface 34 extending in the right and left direction between the pair of right and left inner wall surfaces 32 and 33.

Thus, a large unified operation space for maintaining the equipment can be secured in a center part of the floor 31 of the machine room 30.

Figure 2:
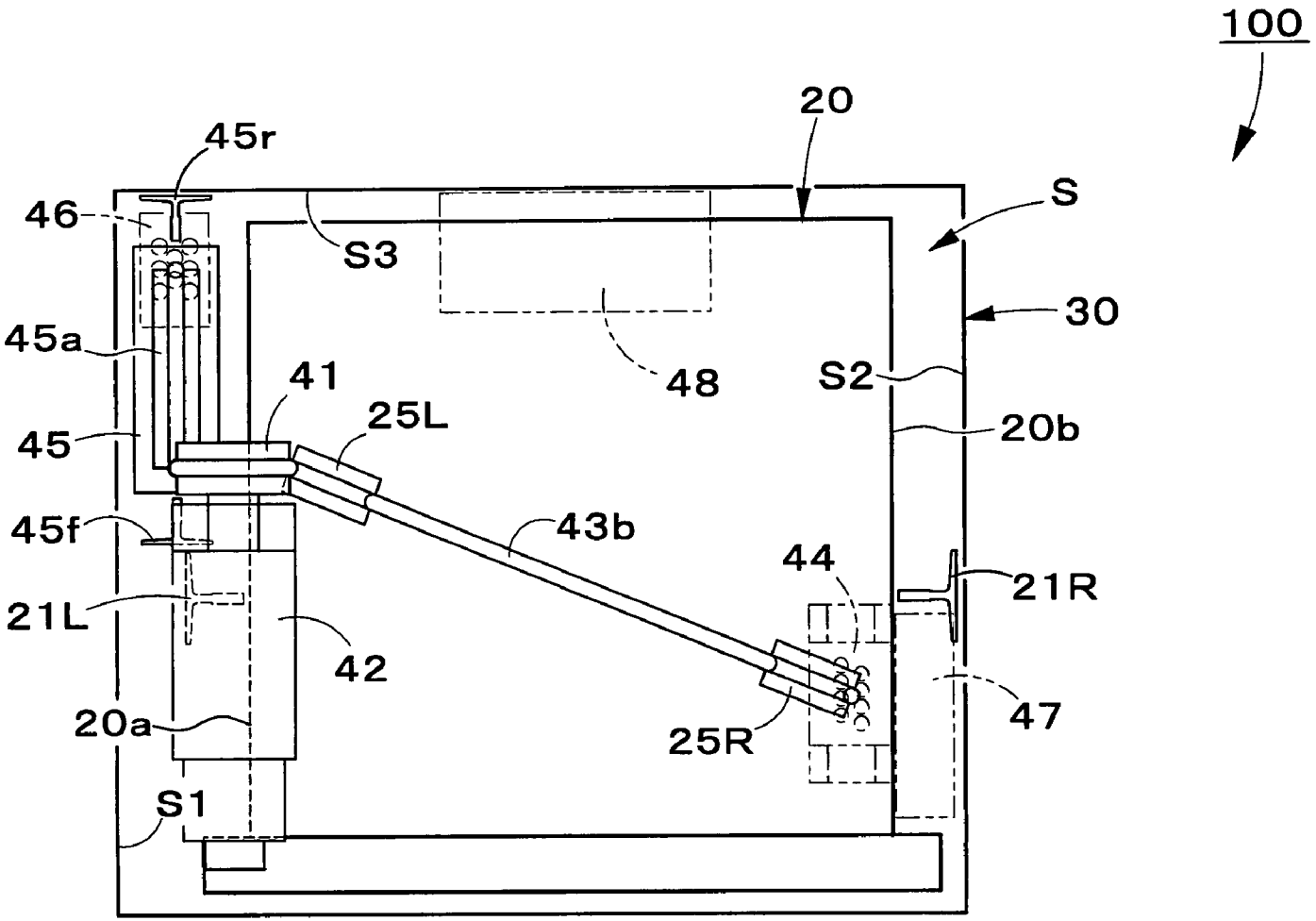
FIG. 2 is a plan view schematically showing a relationship between an elevator shaft and a machine room.
Figure 3:
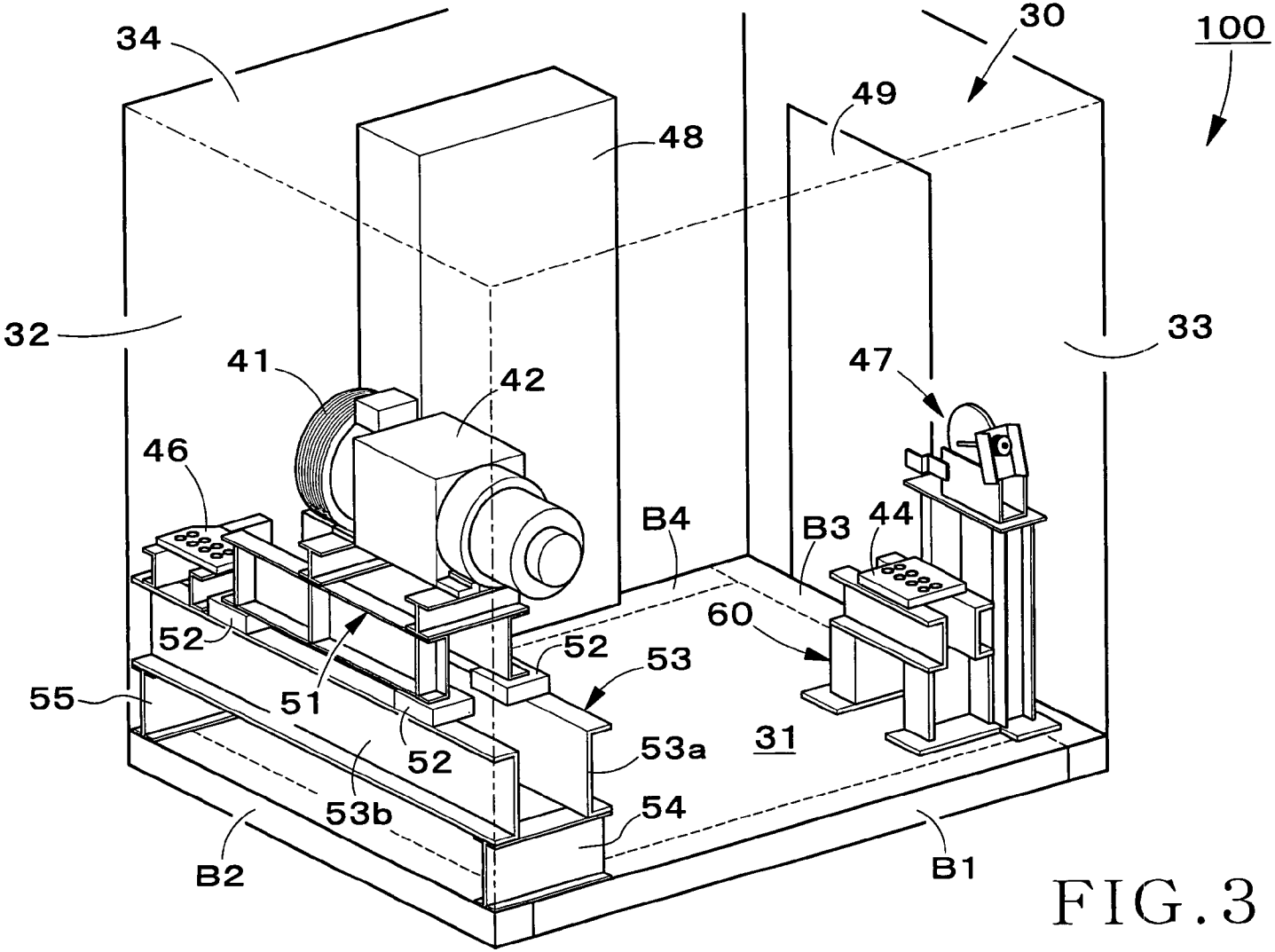
FIG. 3 is a perspective view of the machine room shown in FIG. 1 in which equipment is installed.

That is, in the elevator 100 in the first embodiment shown in FIG. 2, since the traction sheave 41, the driving apparatus 42, and the counterweight-side rope hitching portion 46 are disposed on an upper part of the left cage-side guide rail 21L, this equipment can be arranged along the left inner wall surface 32 of the machine room 30.

Since the cage 20 is supported by the pair of right and left cage-side sheaves 25L and 25R, the cage-side rope hitching portion 44 can be arranged near the right inner wall surface 33 of the machine room 30.

In addition, since the pair of right and left cage-side sheaves 25L and 25R is respectively arranged close to the right and left side walls 20*a* and 20*b* of the cage 20, the traction sheave 41 and the driving apparatus 42 can be largely spaced apart from the cage-side rope hitching portion 44 in the right and left direction.

Thus, a sufficiently large operation space can be secured in a center part of the floor 31 of the machine room 30.

A machine bed 51 for supporting the driving apparatus 42 is mounted on a machine beam 53 formed by combining a pair of right and left C-shaped steels 53*a* and 53*b*, through four rubber cushions 52.

The machine beam 53 is extended at full length in the back and forth direction in the machine room 30 to be passed between a pair of front and rear upward rising machine beams 54 and 55 extending in the right and left direction along the front and rear edges of the machine room 30.

The pair of front and rear upward rising machine beams 54 and 55 are mounted on a pair of front and rear building-side receiving beams B1 and B4 which extend in the right and left direction along the front and rear edges of the machine room 30, and a building-side receiving beam B2 which extends in the back and forth direction along a left edge of the machine room 30.

Thus, the elevator 100 in this embodiment needs no additional receiving beam on a building side, which is for the machine beam 53 supporting the driving apparatus 42.

The cage-side rope hitching portion 44 arranged along the right inner wall surface 33 of the machine room 30 can be supported by a supporting frame 60 disposed on the floor 31, provided that the floor 31 of the machine room 30 has a sufficient strength.

Since the speed governor 47 arranged adjacent to the cage-side rope hitching portion 44 along the right inner wall surface 33 is disposed on a position higher than the cage-side rope hitching portion 44, a maintenance operation of the speed governor 47 can be easily carried out.

Both of the cage-side rope hitching portion 44 and the speed governor 47 are arranged such that they are spaced apart from the rear inner wall surface 34 to the front. Thus, as shown in FIG. 4, a machine room door 49 can be disposed on the right inner wall surface 33.

Figure 5:
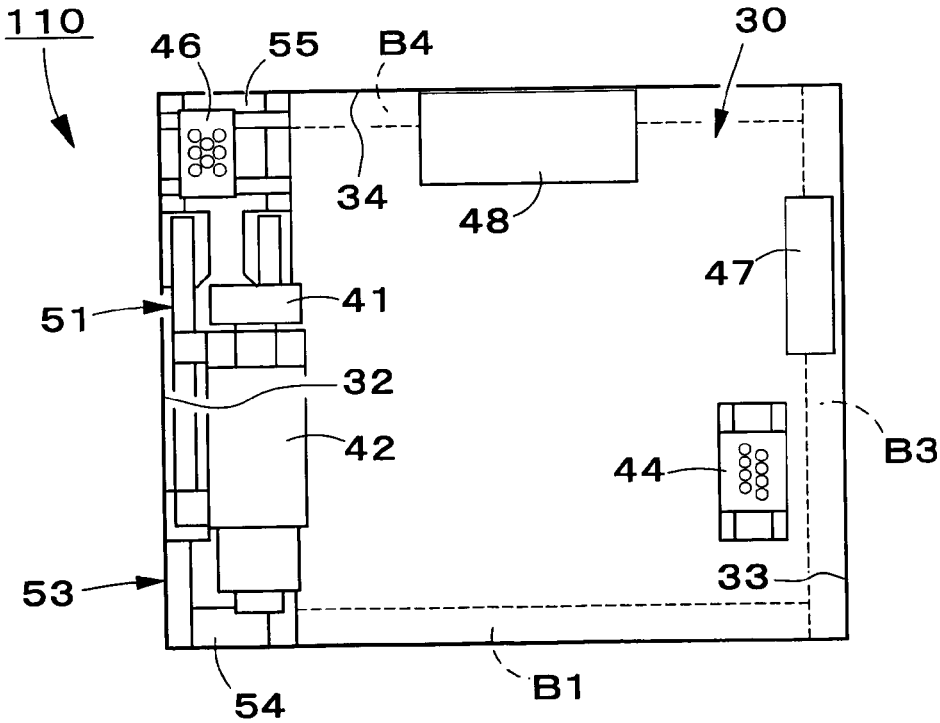
FIG. 5 is a plan view of a first example of the machine room shown in FIG. 4.

In accordance with a change of an arrangement of the pair of right and left cage-side sheaves 25L and 25R, the speed governor 47 may be arranged close to the rear inner wall surface 34, as in an elevator 110 of a first example shown in FIG. 5.

Figure 4:
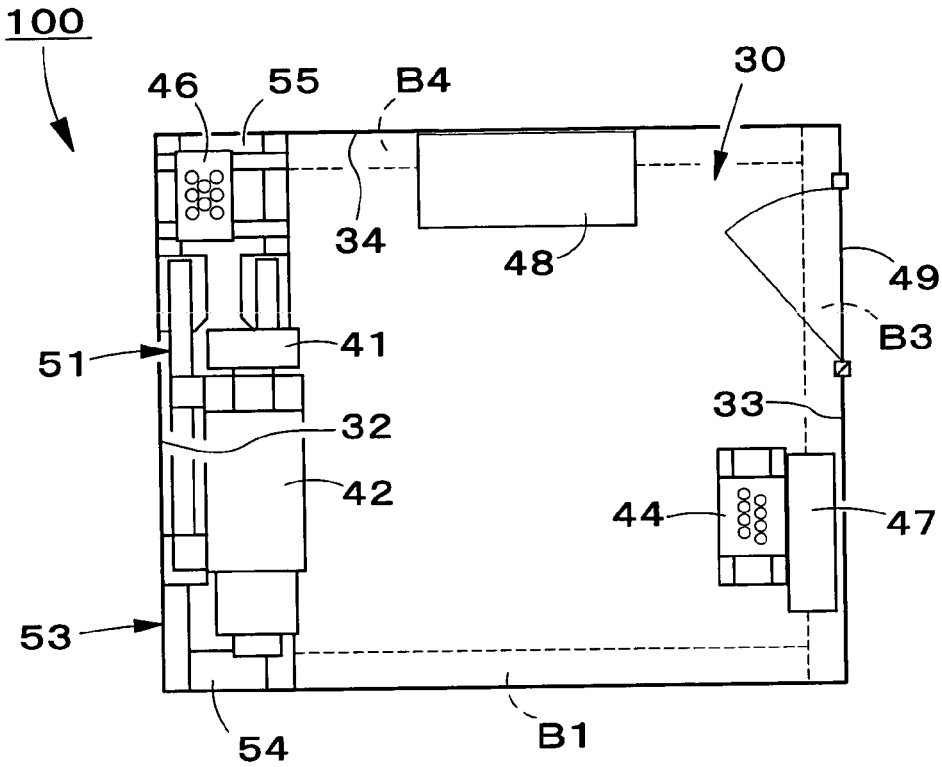
FIG. 4 is a plan view of the machine room shown in FIG. 3.
Figure 6:
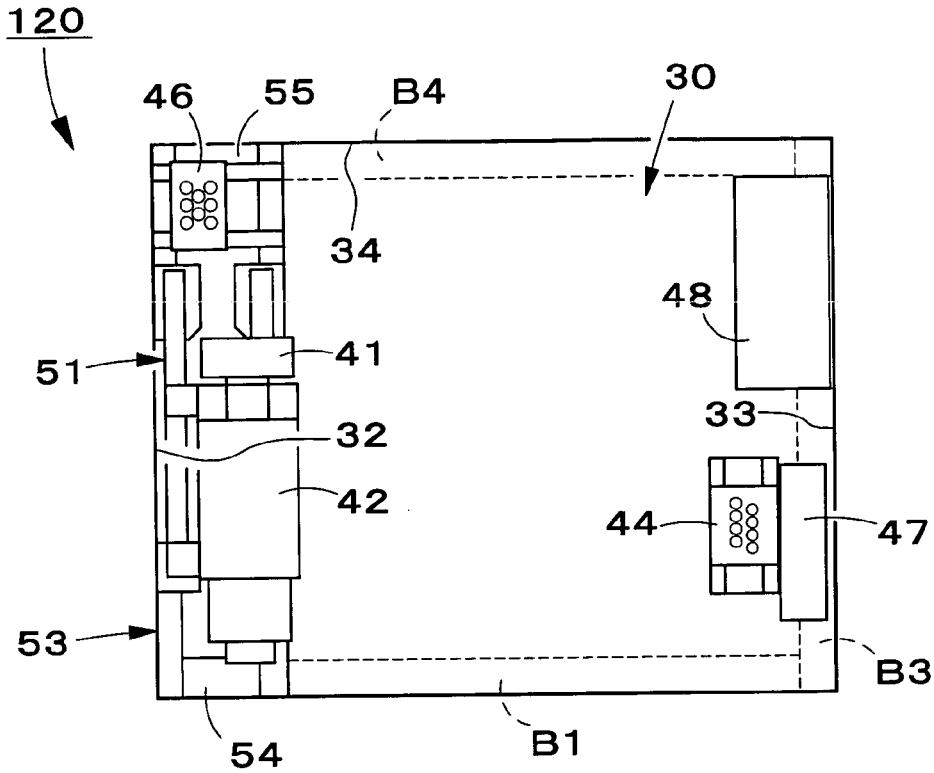
FIG. 6 is a plan view of a second example of the machine room shown in FIG. 4.

As in an elevator 120 of a second example shown in FIG. 6, the control panel 48, in place of the machine room door 49 in FIG. 4, may be arranged along a portion of the right inner wall surface 33 adjacent to the rear inner wall surface 34.

Figure 7:
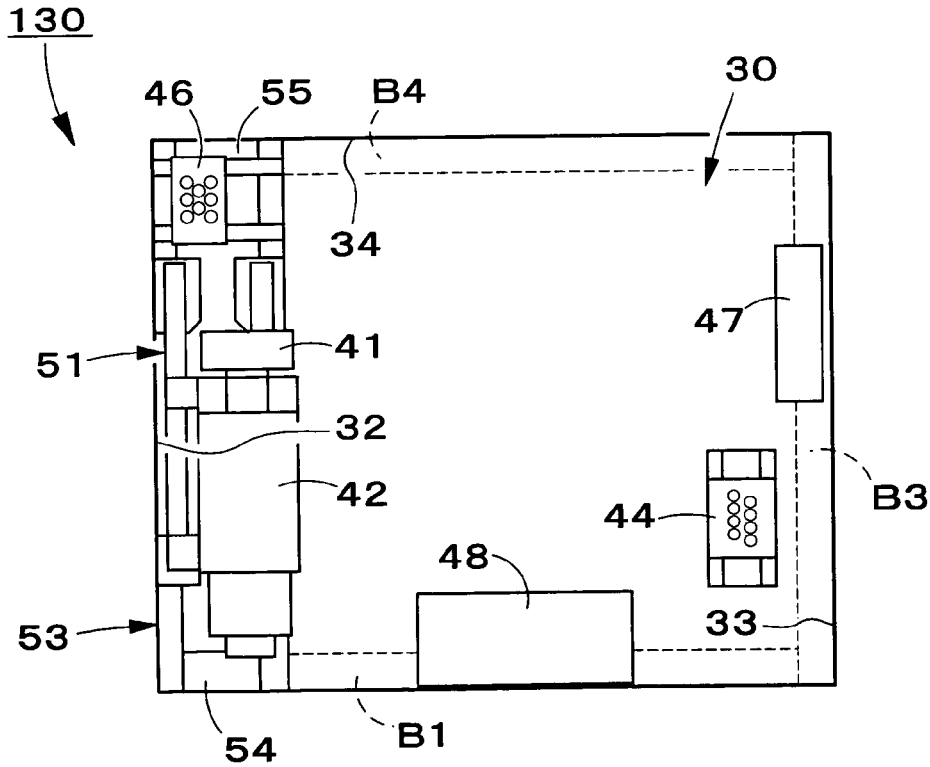
FIG. 7 is a plan view of a third example of the machine room shown in FIG. 4.

In addition, as in an elevator 130 of a third example shown in FIG. 7, the control panel 48 may be arranged along a rear-side inner wall surface 25 extending in the right and left direction between the pair of right and left inner wall surfaces 32 and 33.

Second Embodiment

An elevator 200 in a second embodiment is described with reference to FIGS. 8 to 12.

In the elevator 100 in the first embodiment, the cage-side rope hitching portion 44 is supported by the supporting frame 60 disposed on the floor 31 of the machine room 30.

However, in the case where the floor 31 of the machine room 30 does not have a sufficient strength, or the cage 20 is large and heavy, the cage-side hitching portion 44 cannot be directly supported by the floor 31 of the machine room 30.

Figure 8:
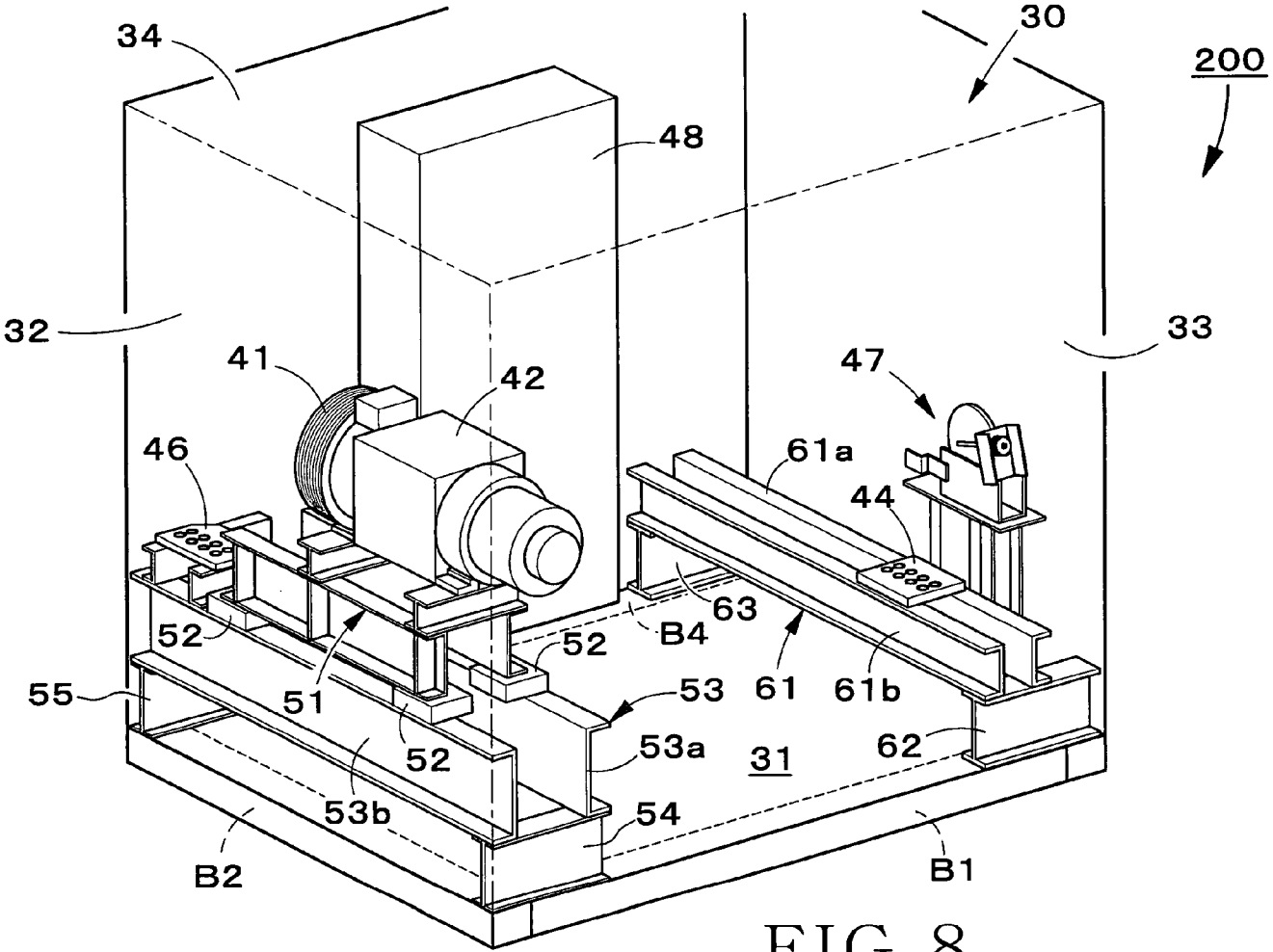
FIG. 8 is a perspective view of a machine room of an elevator in a second embodiment according to the present invention in which equipment is installed.
Figure 9:
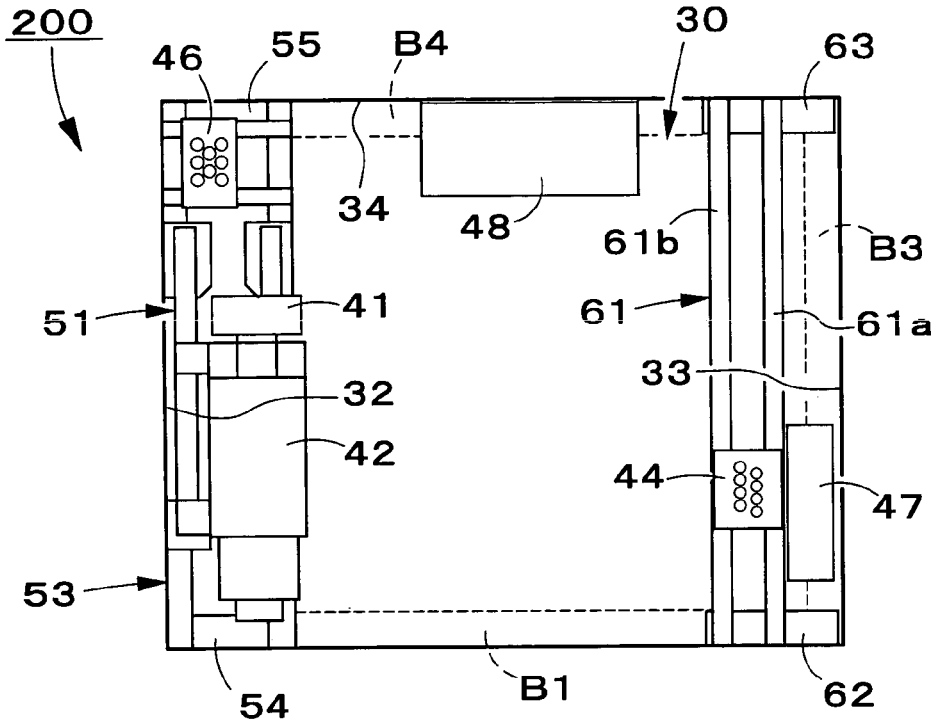
FIG. 9 is a plan view of the machine room shown in FIG. 8.

In such cases, as shown in FIGS. 8 and 9, the cage-side rope hitching portion 44 is supported by a supporting beam 61 formed by a pair of right and left C-shaped steels 61*a* and 61*b* which are extending at full length in the back and forth direction in the machine room 30.

A pair of front and rear upward rising supporting beams 62 and 63 are mounted and secured on the building-side receiving beams B1 and B4 extending along front and rear edges of the machine room 30 in the right and left direction. Front and rear ends of the supporting beam 61 are mounted and secured on the upward rising supporting beams 62 and 63.

Thus, when a sufficient strength is not secured on the floor 31 of the machine room 30, a large operation space can be secured in a center part of the floor 31 of the machine room 30, while tightly supporting the cage-side rope hitching portion 44.

Figure 10:
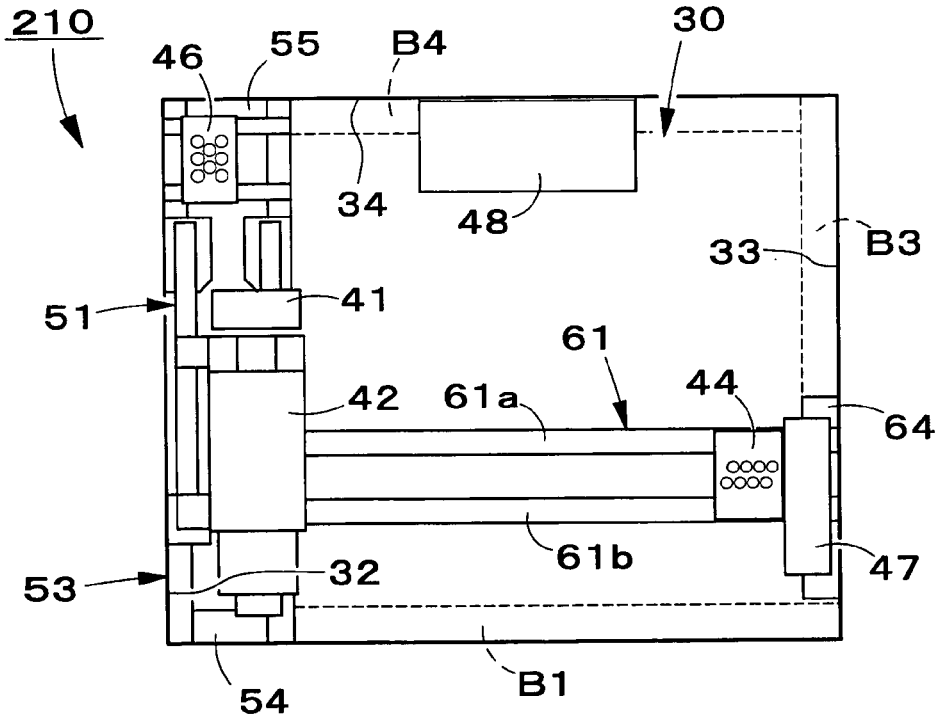
FIG. 10 is a plan view of a first example of the machine room shown in FIG. 9.

As in an elevator 210 of a fourth example shown in FIG. 10, the supporting beam 61 which supports the cage-side rope hitching portion 44 may be arranged to extend in the right and left direction in the machine room 30.

In this case, an upward rising supporting beam 64, on which a right end of the supporting beam 61 is mounted, is mounted and secured on a building-side receiving beam B3 extending along a right edge of the machine room 30 in the back and forth direction.

At the same time, a left end of the supporting beam 61 is connected to the machine beam 53.

Figure 11:
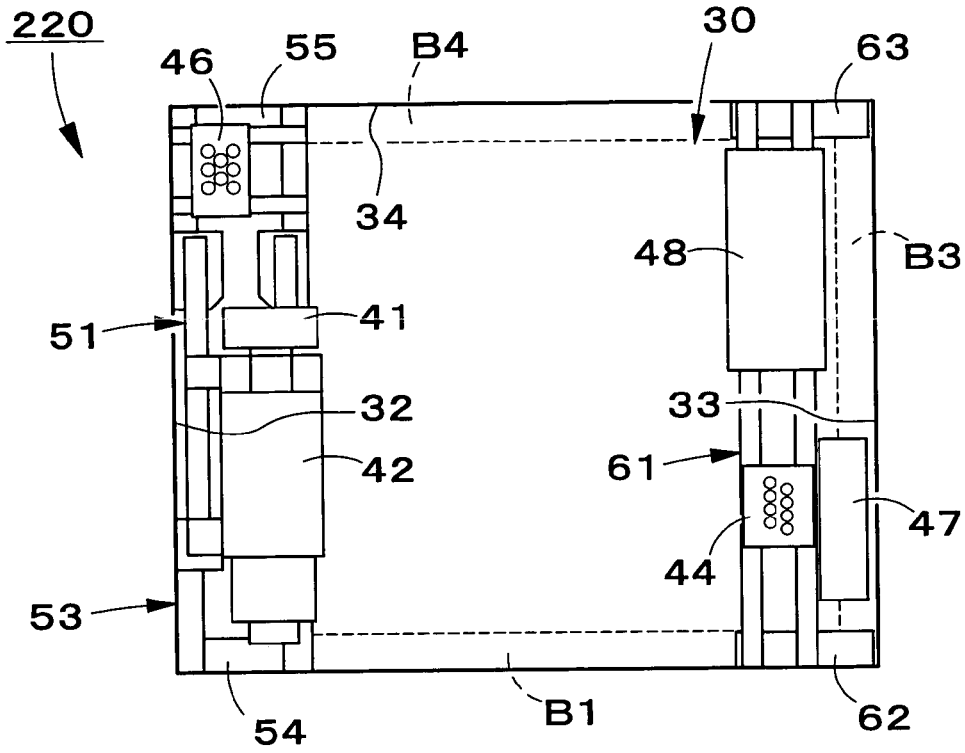
FIG. 11 is plan view of a second example of the machine room shown in FIG. 9.

As in an elevator 220 of a fifth example shown in FIG. 11, the control panel 48 may be mounted on the supporting frame 60 extending in the back and forth direction.

Figure 12:
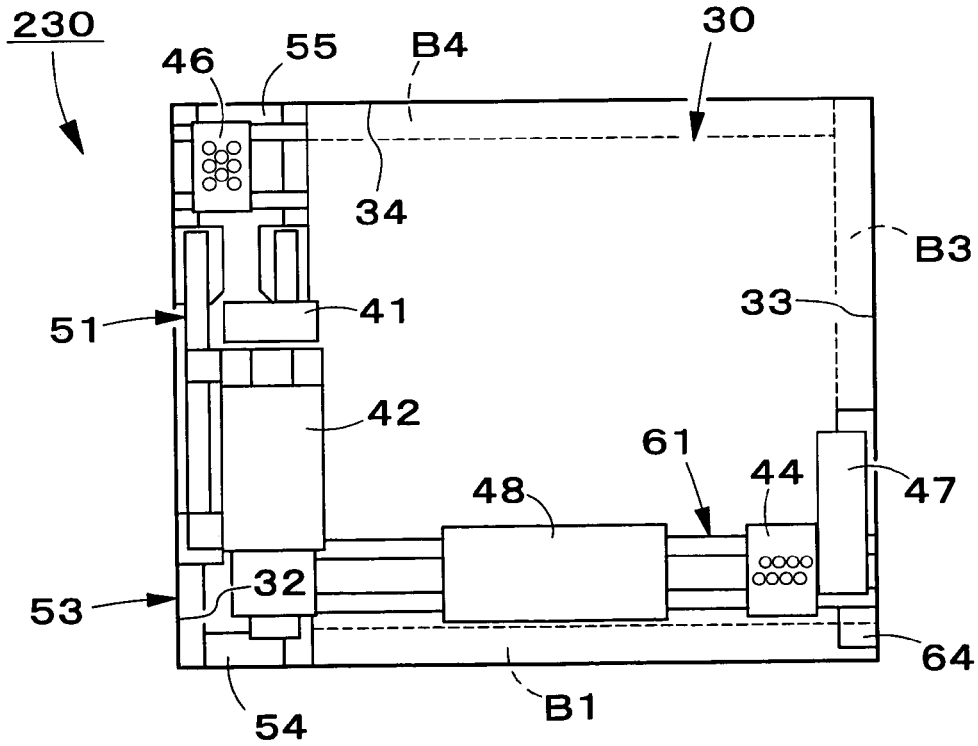
FIG. 12 is a plan view of a third example of the machine room shown in FIG. 9.

As in an elevator 230 of a sixth example shown in FIG. 12, the control panel 48 may be mounted on the supporting frame 60 extending in the back and forth direction.

Third Embodiment

Figure 13:
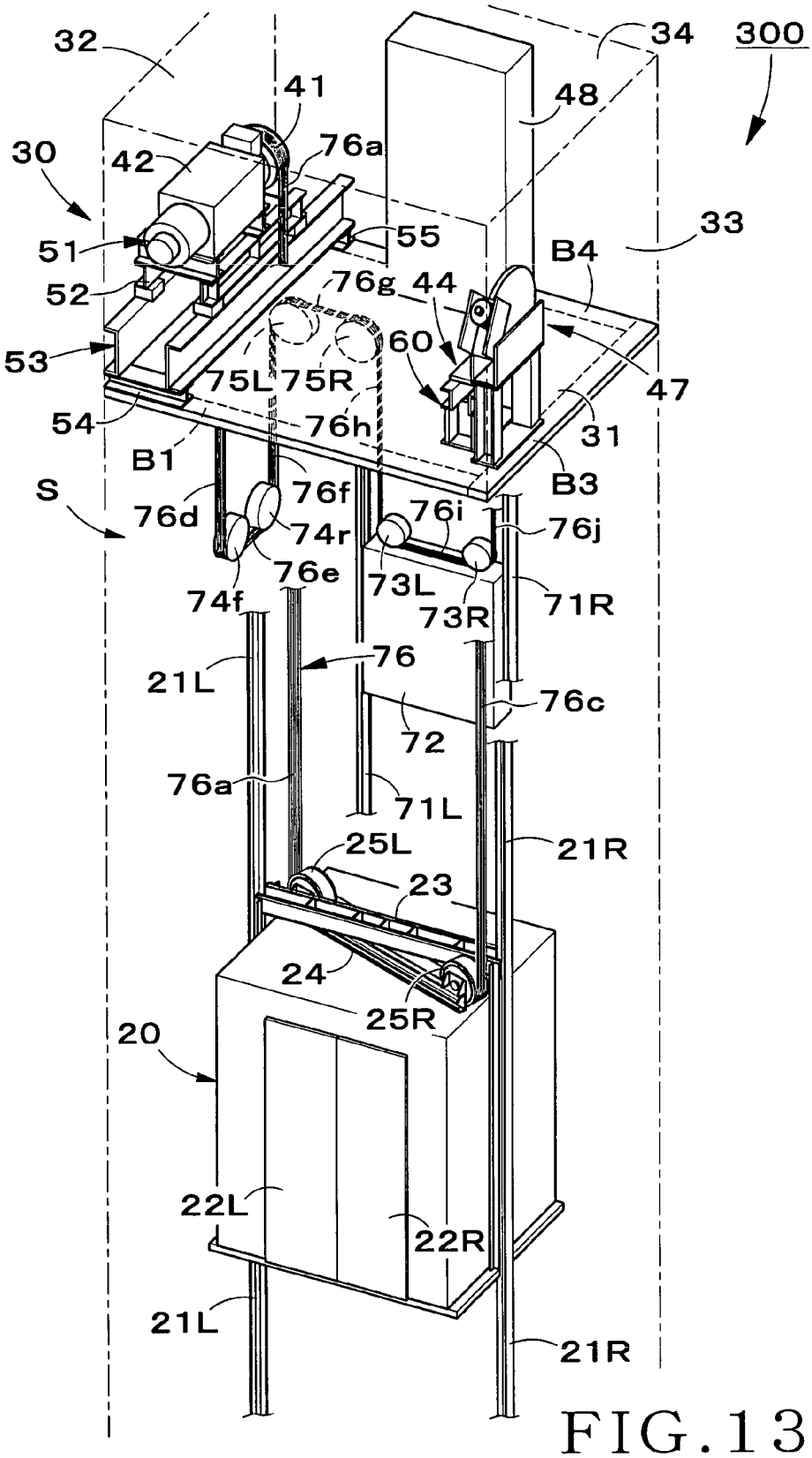
FIG. 13 is a perspective view of an elevator in a third embodiment according to the present invention.

A general structure of an elevator in a third embodiment is described with reference to FIGS. 13 and 14.

In an elevator 300 in a third embodiment, the cage 20 is guided by the pair of right and left cage-side guide rails 21L and 21R to vertically move in the elevator shaft S installed in a building.

The pair of right and left doors 22L and 22R disposed on a front surface of the cage 20 is opened/closed in the right and left direction.

The cage frame supporting the cage 20 includes the upper beam 23 horizontally extending above the cage 20 in the right and left direction, and the sheave supporting beam 24 connected to the upper beam 23 such that an upper surface of the sheave supporting beam 24 is tightly in contact with a longitudinal center part of a lower surface of the upper beam 23, and that the sheave supporting beam 24 is inclined both in the back and forth direction and the right and left direction in a horizontal plane relative to the upper beam 23.

The pair of right and left cage-side sheaves 25L and 25R is rotatably supported on right and left ends of the sheave supporting beam 24.

A counterweight 72 is disposed behind the cage 20, which is guided by a pair of right and left counterweight-side guide rails 71L and 71R arranged along a rear wall S3 of the elevator shaft 3 to vertically move in the elevator shaft S.

A pair of counterweight-side sheaves 73L and 73R is rotatably supported above the counterweight 72.

The machine room 30 is disposed above the elevator shaft S in which the cage 20 and the counterweight 72 are vertically moved.

On the floor 31 of the machine room 30, above the left cage-side guide rail 21L, or above the left sidewall 20*a* of the cage 20, the traction sheave 41 which rotates about a rotational axis extending in the back and forth direction, and the driving apparatus 42 for driving the traction sheave 41 in rotation having an axis extending back and forth direction are arranged along the left inner wall surface 32 of the machine room 30.

Adjacent to a left inner wall surface S1 of the elevator shaft S in a sufficiently lower part from the traction sheave 41, a pair of lower deflecting sheaves 74*f* and 74*r* are rotatably supported about rotational axes extending in the right and left direction.

Adjacent to a rear inner wall surface S2 of the elevator shaft S directly below the floor 31 of the machine room 30, a pair of right and left upper deflecting sheaves 75L and 75R are rotatably supported about rotational axes extending in the back and forth direction.

A hoist rope 76 passing round the traction sheave 41 suspends the cage 20 and the counterweight 72 like a jig back in a two-to-one arrangement.

The hoist rope 76 includes a part 76*a* pendent from the traction sheave 41 passing through the floor of the machine room 30 to the cage 20, a part 76*b* horizontally extending between the pair of right and left cage-side sheaves 25L and 25R, and a part 76*c* extending upward from the right cage-side sheave 25R to pass through the floor of the machine room 30, with an upper end of the part 76*c* being hitched on the cage-side rope hitching portion 44 in the machine room 30.

The hoist rope 76 includes a part 76*d* pendent from the traction sheave 41 to pass through the floor of the machine room 30, a part 76*e* horizontally extending between the pair of front and rear lower deflecting sheaves 75*f* and 75*r* in the back and forth direction, a part 76*f* extending upward from the rear lower deflecting sheave 74*r* to the left upper deflecting sheave 75L, a part 76*g* horizontally extending between the pair of right and left deflecting sheaves 75L and 75R in the right and left direction, a part 76*h* extending downward from the right upper deflecting sheave 75R to the left counterweight-side sheave 73L, a part 76*i* extending between the pair of right and left counterweight-side sheaves 73L and 73R in the right and left direction, and a part 76*j* extending upward from the right counterweight-side sheave 73R to pass through the floor 31 of the machine room 30 and hitch on a counterweight-side rope hitching portion 78 supported by a supporting frame 77 on the floor 31.

Since each of the ropes forming the hoist rope 76 has an outer diameter of as small as 4 mm to 6 mm, outer diameters of the traction sheave 41, the pair of right and left cage-side sheaves 25L and 25R, the pair of right and left counterweight-side sheaves 73L and 73R, the pair of front and rear lower deflecting sheaves 74*f* and 74*r*, and the pair of right and left upper deflecting sheaves 75L and 75R can be respectively restrained to be from about 200 mm to about 250 mm.

Thus, a degree of freedom of an arrangement of the respective sheaves is enhanced, which also enhances a degree of freedom of a drawing of the hoist rope 76.

The counterweight 72 is vertically moved behind the cage 20 along the rear wall S3 of the elevator shaft S. The traction sheave 41 and the pair of front and rear lower deflecting sheaves 74*f* and 74*r* are arranged adjacent to the left inner wall surface S1 of the elevator shaft S. The pair of right and left upper deflecting sheaves 75L and 75R is arranged on a top of the elevator shaft S adjacent to the rear wall S3.

Thus, the lower deflecting sheaves 74*f* and 74*r* are not interfered with by the counterweight 72.

Since the upper deflecting sheaves 75L and 75R are arranged on an uppermost part of the elevator shaft S, the upper deflecting sheaves 75L and 75R are not interfered with by the counterweight 72. Thus, a sufficiently large vertical stroke of the counterweight 72 can be achieved.

Since the lower deflecting sheaves 74*f* and 74*r* can be arranged sufficiently below the traction sheave 41, it is possible to realize a gentle curve of a portion of the hoist rope 76 from the traction sheave 41 to the left counterweight-side sheave 73L through the lower deflecting sheaves 74*f* and 74*r* and the upper deflecting sheaves 75L and 75R.

As a result, a durability of the hoist rope 76 can be improved. Since no tensile difference is generated in the respective parts of the hoist rope 76, vertical vibrations of the cage 20 can be prevented when a vertical movement of the cage 20 restarts after the cage 20 is stopped. Further, it is possible to prevent a generation of noises and vibrations accompanied with a contact of the respective ropes forming the hoist rope with rope grooves of the respective sheaves.

Figure 15:
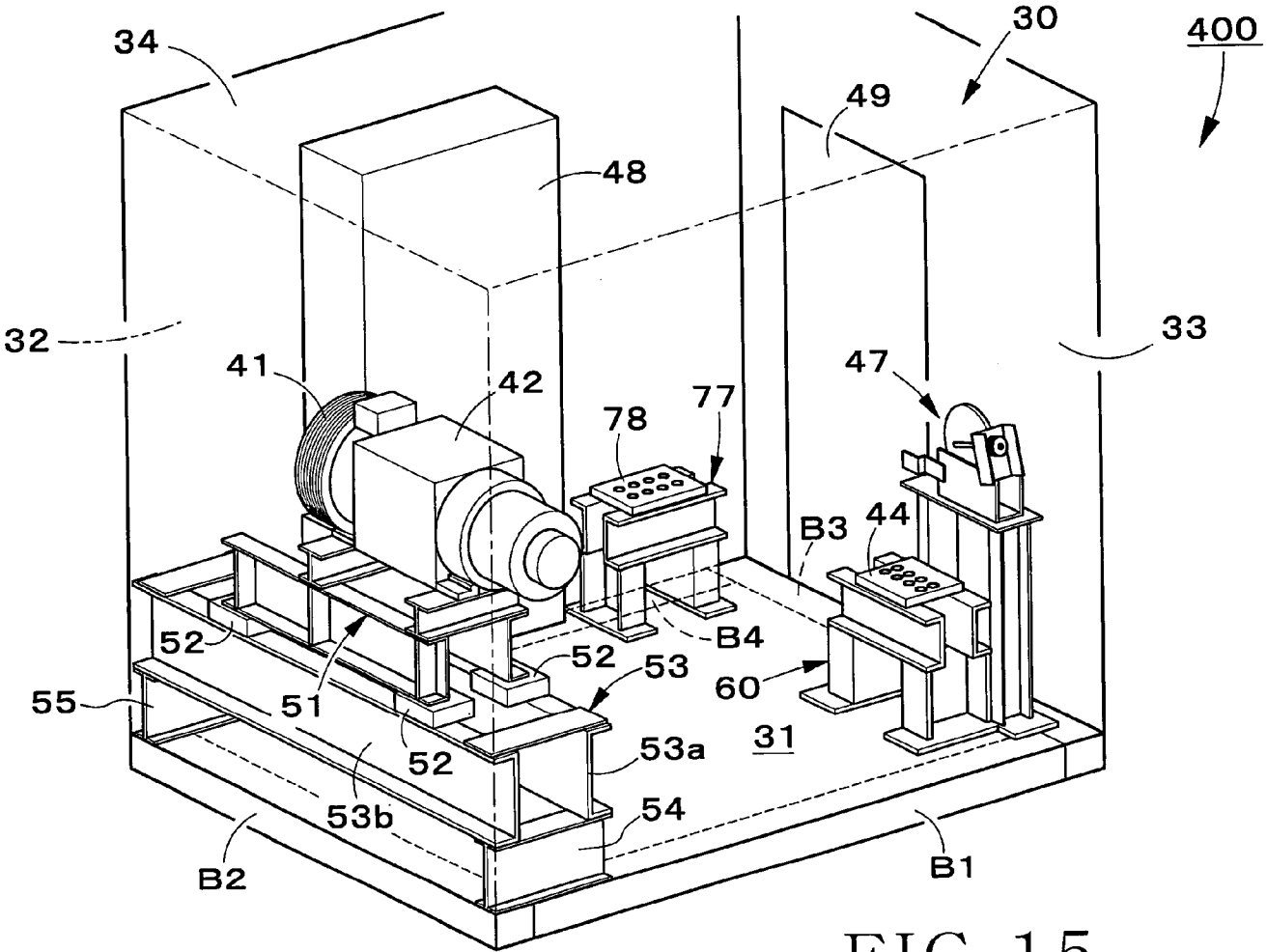
FIG. 15 is a perspective view of the machine room shown in FIG. 13 in which equipment is installed.
Figure 16:
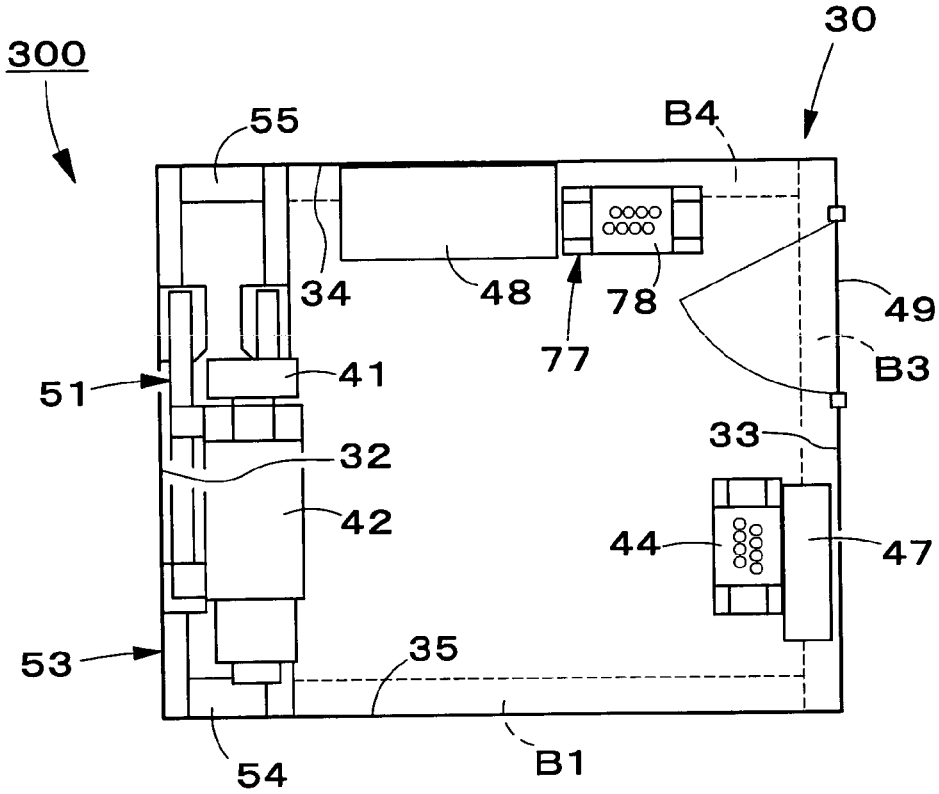
FIG. 16 is a plan view of the machine room shown in FIG. 15.

A layout of the machine room 30 is described with reference to FIGS. 15 to 16. The traction sheave 41 and the driving apparatus 42, each having an axis extending in the back and forth direction, are arranged along the left inner wall surface 32 of the pair of right and left inner wall surfaces 32 and 33 which extend opposite to each other in the back and forth direction.

The cage-side rope hitching portion 44 and the speed governor 47 are arranged along the right inner wall surface 33.

The control panel 48 for controlling an operation of the driving apparatus 42 and so on, and the counterweight-side hitching portion 78 are arranged along the rear inner wall surface 34 extending between the pair of right and left inner wall surfaces 32 and 33 in the right and left direction.

Thus, a large unified operation space for maintaining the equipment can be secured in a center part of the floor 31 of the machine room 30.

Figure 14:
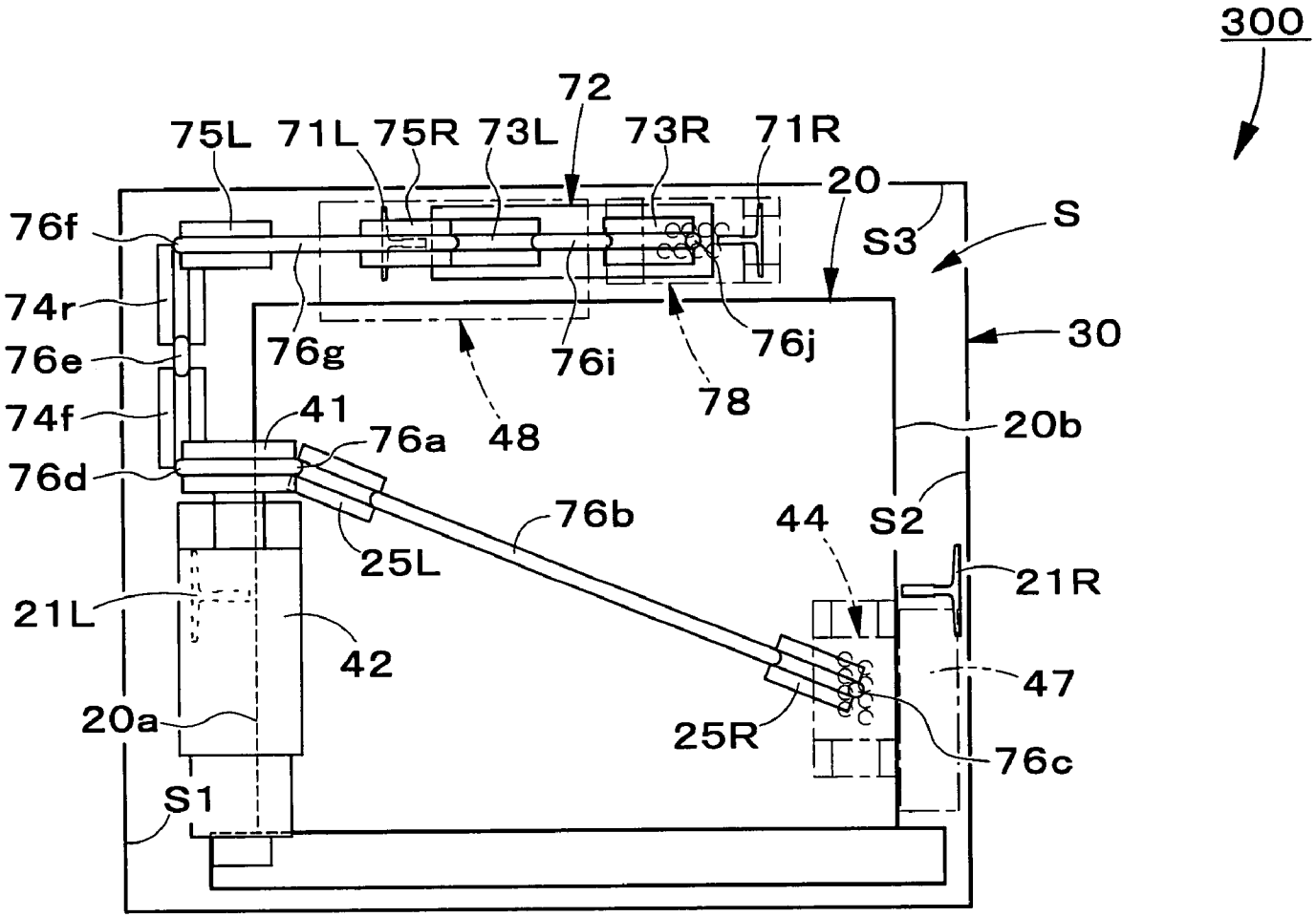
FIG. 14 is a plan view schematically showing a relationship between an elevator shaft and a machine room.

That is, in the elevator 300 in the third embodiment shown in FIG. 14, since the traction sheave 41 and the driving apparatus 42 are disposed above the left cage-side guide rail 21L, the equipment can be arranged along the left inner wall surface 32 of the machine room 30.

Since the cage 20 is supported by the pair of right and left cage-side sheaves 25L and 25R, the cage-side rope hitching portion 44 can be arranged along the right inner wall surface 33 of the machine room 30.

In addition, since the pair of right and left cage-side sheaves 25L and 25R is respectively arranged close to the right and left side walls 20*a* and 20*b* of the cage 20, the traction sheave 41 and the driving apparatus 42 can be largely spaced apart from the cage-side rope hitching portion 44 in the right and left direction.

Thus, a sufficiently large operation space can be secured in a center part of the floor 31 of the machine room 30.

In the elevator 300 of the third embodiment shown in FIG. 14, since the counterweight 72 is arranged behind the cage 20 to vertically move along the rear wall S3 of the elevator shaft S, the counterweight-side rope hitching portion 78 can be arranged along the rear inner wall surface 34 of the machine room 30.

A part of the hoist rope 76 suspending the counterweight 72 is passed between the pair of right and left upper deflecting sheaves 75L and 75R and the pair of right and left counterweight-side sheaves 73L and 73R which are arranged adjacent to the rear wall S3 of the elevator shaft S. Thus, the counterweight-side rope hitching portion 78 can be arranged on a portion of the rear inner wall surface 34 of the machine room 30 near the right inner wall surface 33 of the machine room 30.

Thus, the control panel 48 for controlling the driving apparatus 42 and so on can be arranged between the traction sheave 41 and the counterweight-side rope hitching portion 78 along the rear inner wall surface 34 of the machine room 30.

As a result, maintenance of the control panel 48 can be carried out in a large operation space secured in a center part of the floor 31 of the machine room 30.

Since the cage-side rope hitching portion 44 and the speed governor 47 are arranged on a front side of the right inner wall surface 33 of the machine room 30, the machine room door 49 can be disposed on a rear side portion of the right inner wall surface 33 of the machine room 30.

Figure 17:
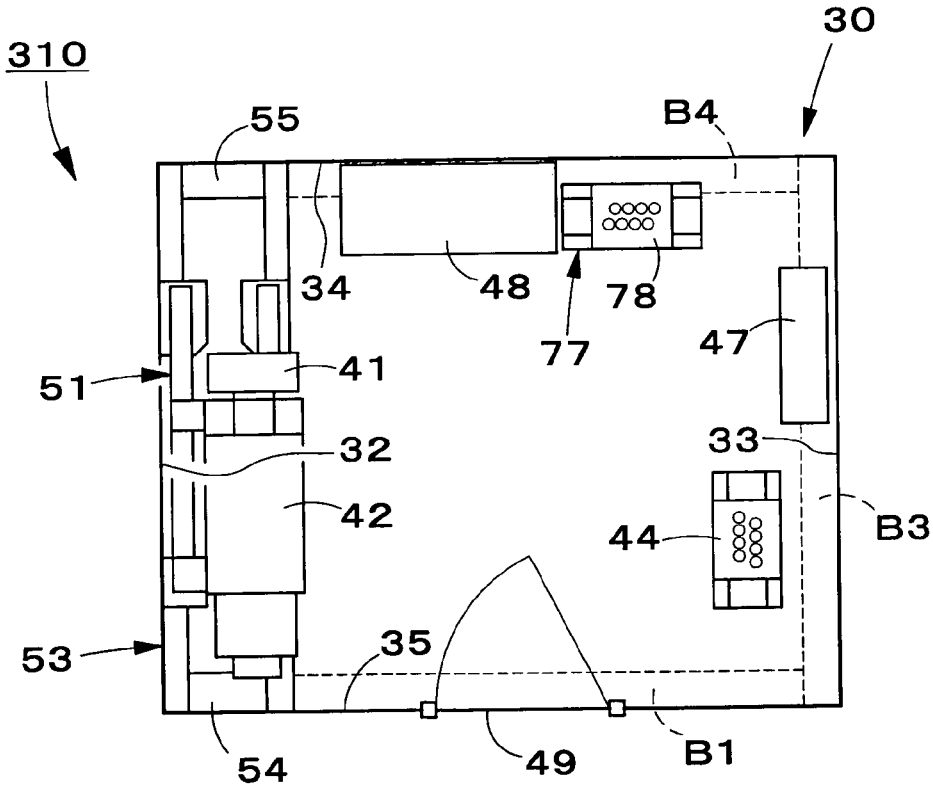
FIG. 17 is a plan view of a first example of the machine room shown in FIG. 16.

As in an elevator 310 of a first example shown in FIG. 17, the speed governor 47 may be arranged close to the rear inner wall surface 34 of the machine room 30. In this case, the machine room door 49 can be disposed on the front inner wall surface 35 of the machine room 30.

Figure 18:
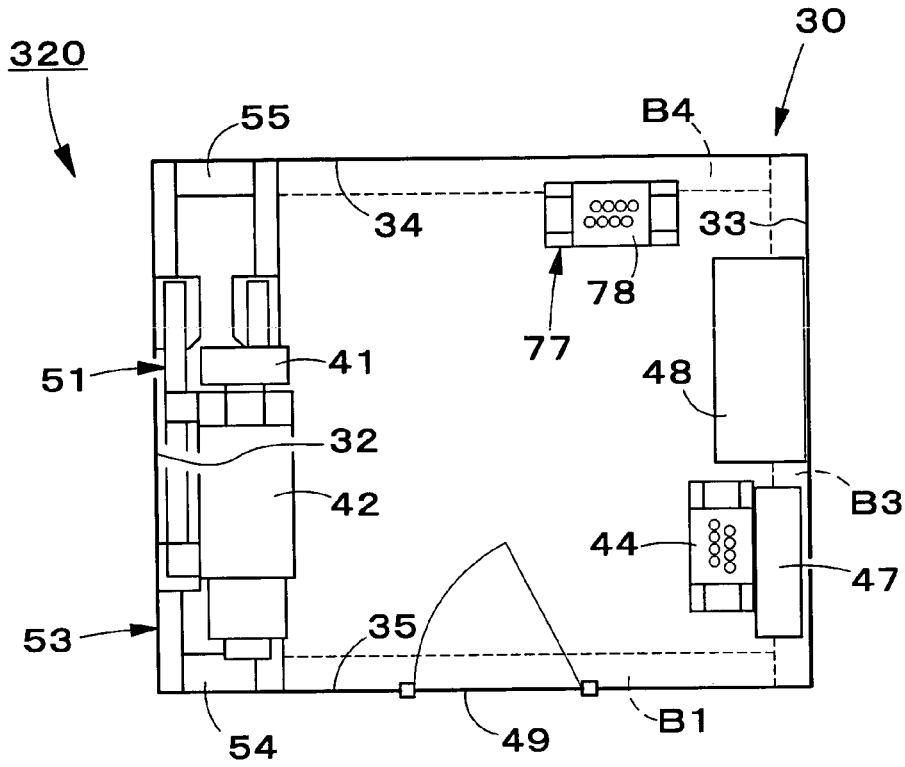
FIG. 18 is a plan view of a second example of the machine room shown in FIG. 16.

As in an elevator 320 of a second example shown in FIG. 18, the control panel 48 may be arranged along a portion of the right inner wall surface 33 adjacent to the rear inner wall surface 34 of the machine room. Also in this case, the machine room door 49 can be disposed on the front inner wall surface 35 of the machine room 30.

Figure 19:
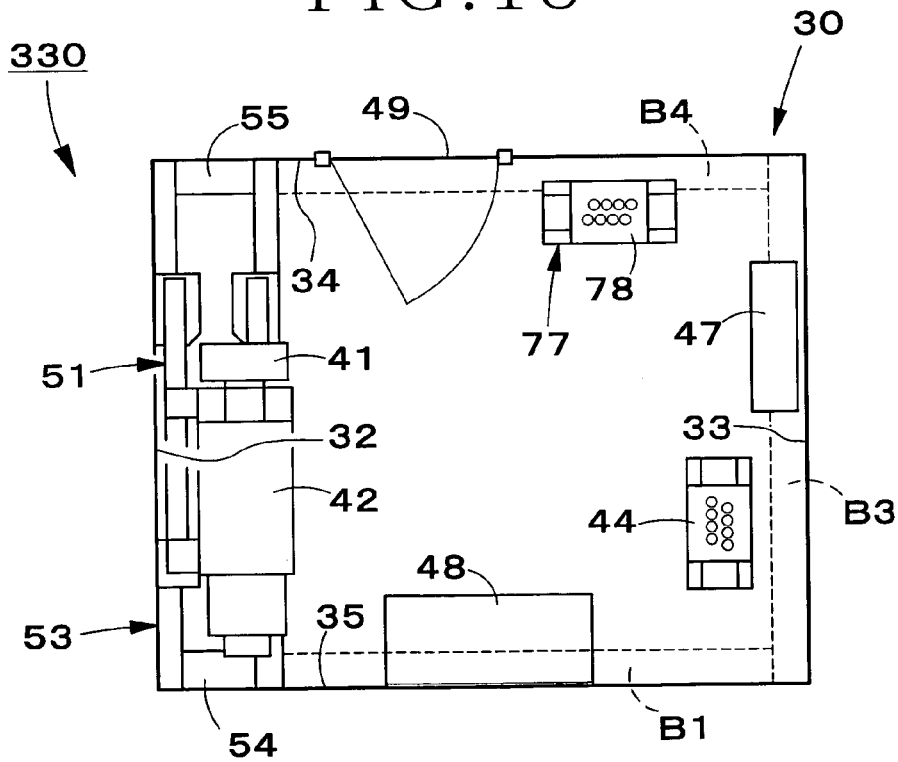
FIG. 19 is a plan view of a third example of the machine room shown in FIG. 16.

As in an elevator 330 of a third example shown in FIG. 19, the control panel 48 may be arranged along a portion of the right inner wall surface 33 adjacent to the front inner fall surface 35 of the machine room. In this case, the machine room door 49 can be disposed on the rear inner wall surface 34 of the machine room 30.

The pair of front and rear lower deflecting sheaves 75*f* and 75*r*, and the pair of right and left upper deflecting sheaves 75L and 75R is used for guiding a portion of the hoist rope 76 extending from the traction sheave 41 to the counterweight 72. However, the pair of front and rear lower deflecting sheaves 75*f* and 75*r* may be replaced with a single lower deflecting sheave, and the pair of right and left upper deflecting sheaves 75L and 75R may be replaced with a single upper deflecting sheave.

In addition, the pair of right and left counterweight-side sheaves 73L and 73R may be replaced with a single counterweight-side sheave.

Fourth Embodiment

An elevator 400 in a fourth embodiment is described with reference to FIGS. 20 and 21.

In the elevator 300 in the third embodiment, the counterweight-side rope hitching portion 78 is supported by the supporting frame 77 disposed on the floor 31 of the machine room 30.

However, in the case where the floor 31 of the machine room 30 does not have a sufficient strength, or the cage 20 is large and heavy, the counterweight-side rope hitching portion 78 cannot be directly supported by the floor 31 of the machine room 30.

Figure 20:
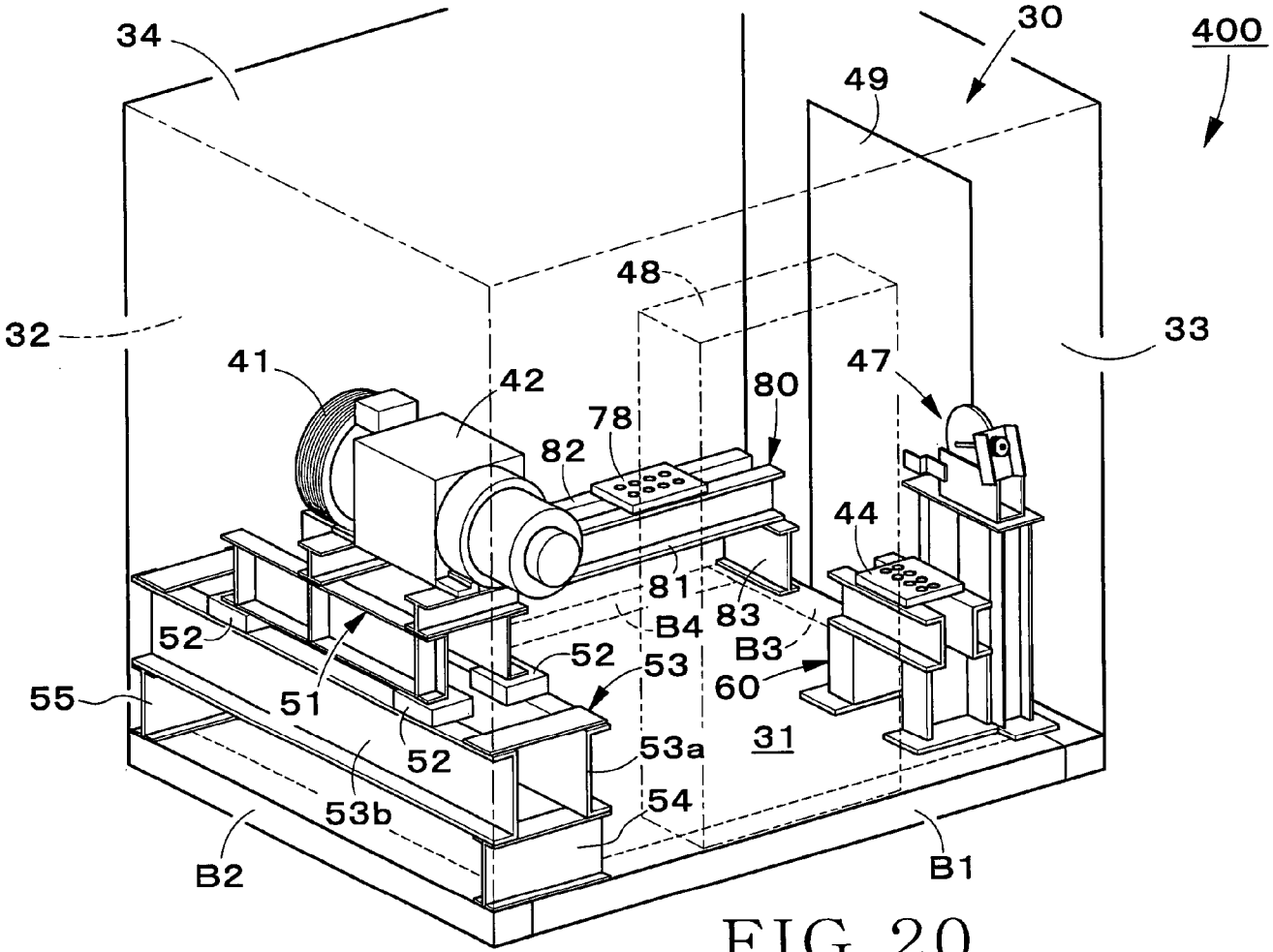
FIG. 20 is a perspective view of a machine room of an elevator in a fourth embodiment according to the present invention in which equipment is installed.
Figure 21:
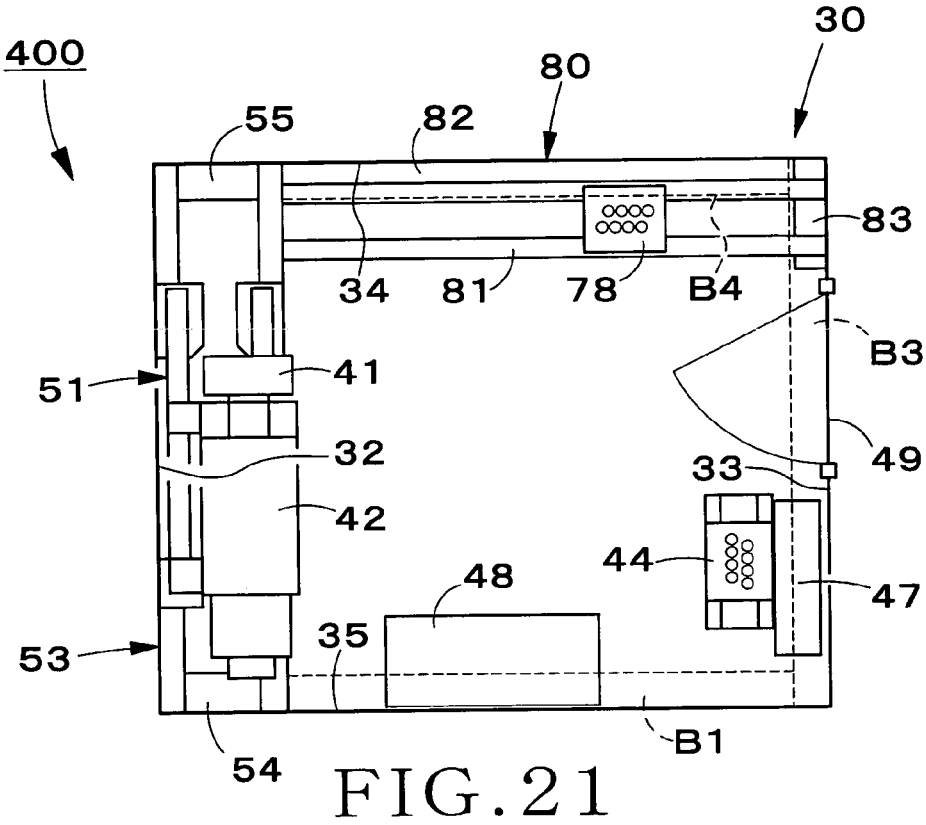
FIG. 21 is a plan view of the machine room shown in FIG. 20.

In such cases, as shown in FIGS. 20 and 21, the counterweight-side rope hitching portion 78 is supported by a supporting beam 80 extending along the rear inner wall surface 34 of the machine room 30 in the right and left direction.

The supporting beam 80 is composed of a pair of front and rear C-shaped steels 81 and 82. A right end of the supporting beam 80 is mounted and secured on an upward rising supporting beam 83 which is arranged on the building-side receiving beam B3 and is extending in the back and forth direction. A left end of the supporting beam 80 is connected to the machine beam 53 and secured thereon.

Thus, when a sufficient strength is not secured on the floor 31 of the machine room 30, a large operation space can be secured in a center part of the floor 31 of the machine room 30, while tightly supporting the counterweight-side rope hitching portion 78.

By arranging the control panel 48 along the front inner wall surface 35 of the machine room 30, maintenance of the control panel 48 can be carried out in a large operation space in a center part of the floor 31.

Figure 22:
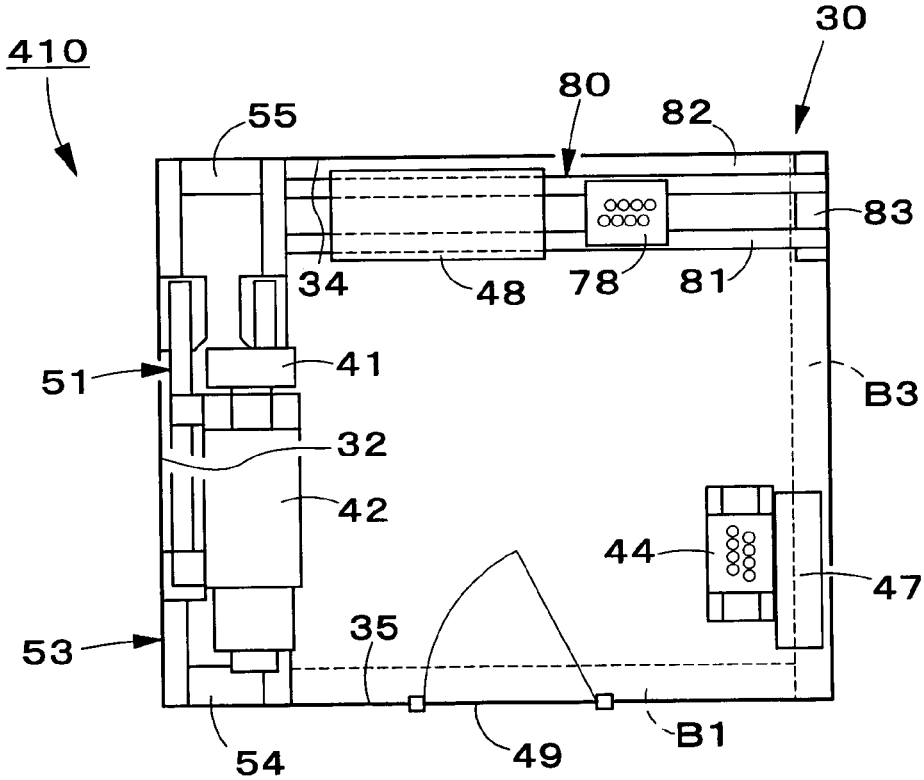
FIG. 22 is plan view of a first example of the machine room shown in FIG. 21.

As in an elevator 410 of a first example shown in FIG. 22, the control panel 48 may be mounted on the supporting beam 80 which supports the counterweight-side rope hitching portion 78. In this case, the machine room door 49 can be disposed on the front inner wall surface 35 of the machine room 30.

Figure 23:
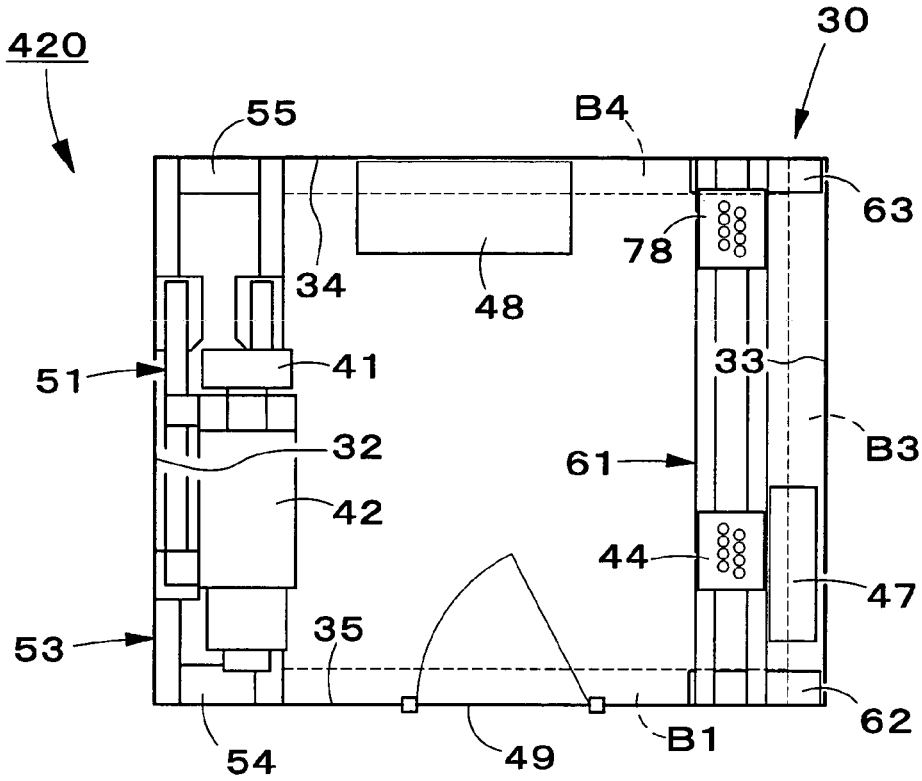
FIG. 23 is a plan view of a second example of the machine room shown in FIG. 21.

As in an elevator 420 of a second example shown in FIG. 23, when the supporting beam 61 is used for supporting the cage-side rope hitching portion 44, the counterweight-side rope hitching portion 78 may be supported on a rear end of the supporting beam 61.

Figure 24:
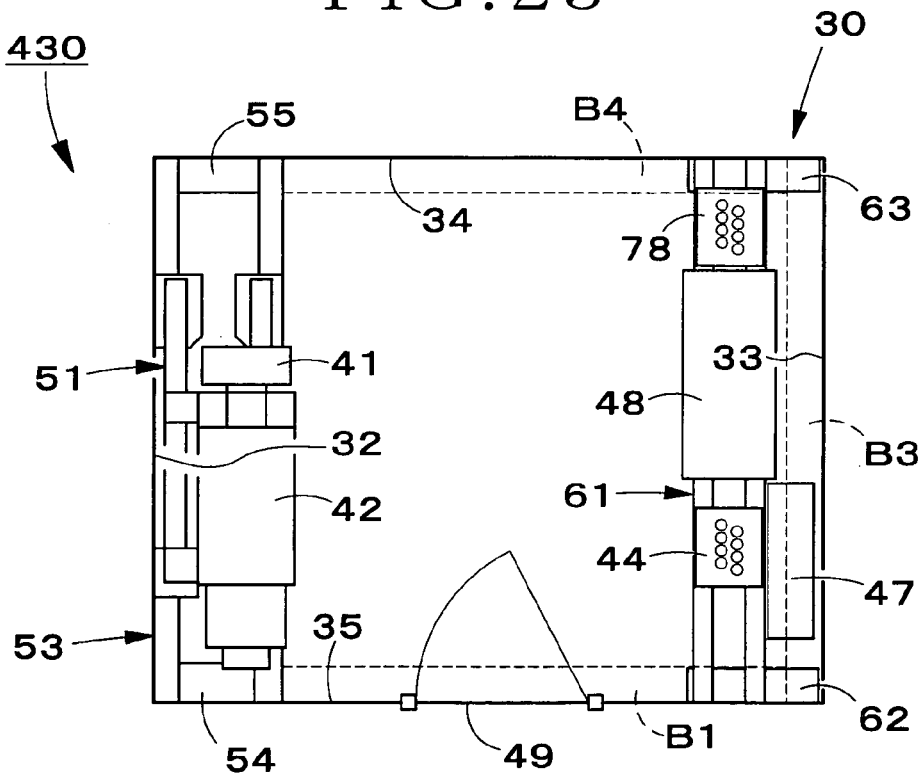
FIG. 24 is a plan view of a third example of the machine room shown in FIG. 21.
Figure 25:
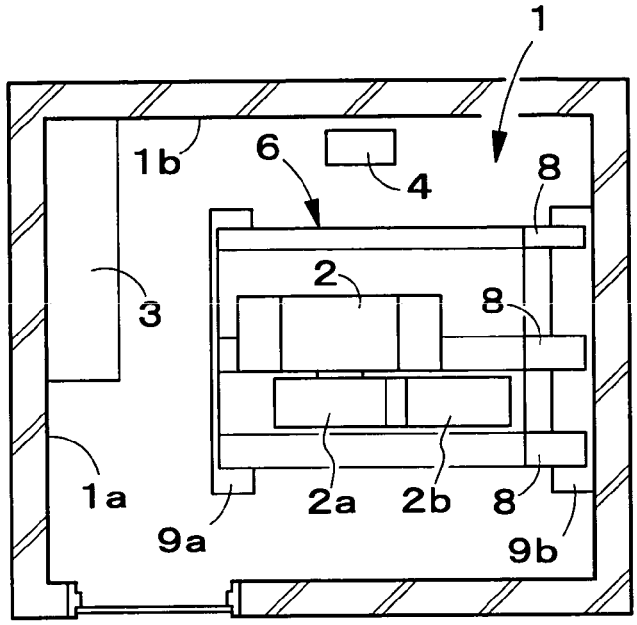
FIG. 25(*a*) is a plan view of a machine room of a conventional elevator.
Figure 25:
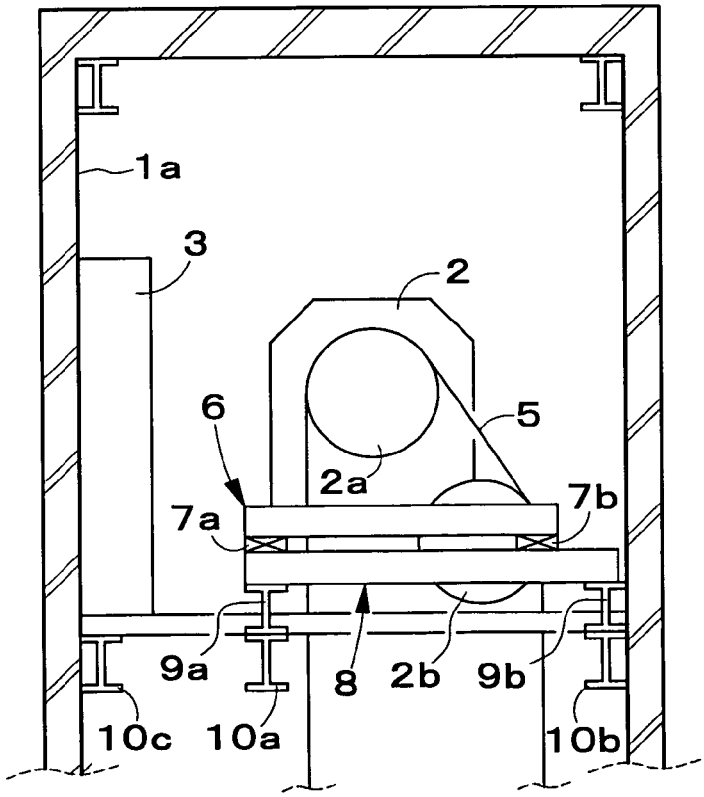
Figure 26:
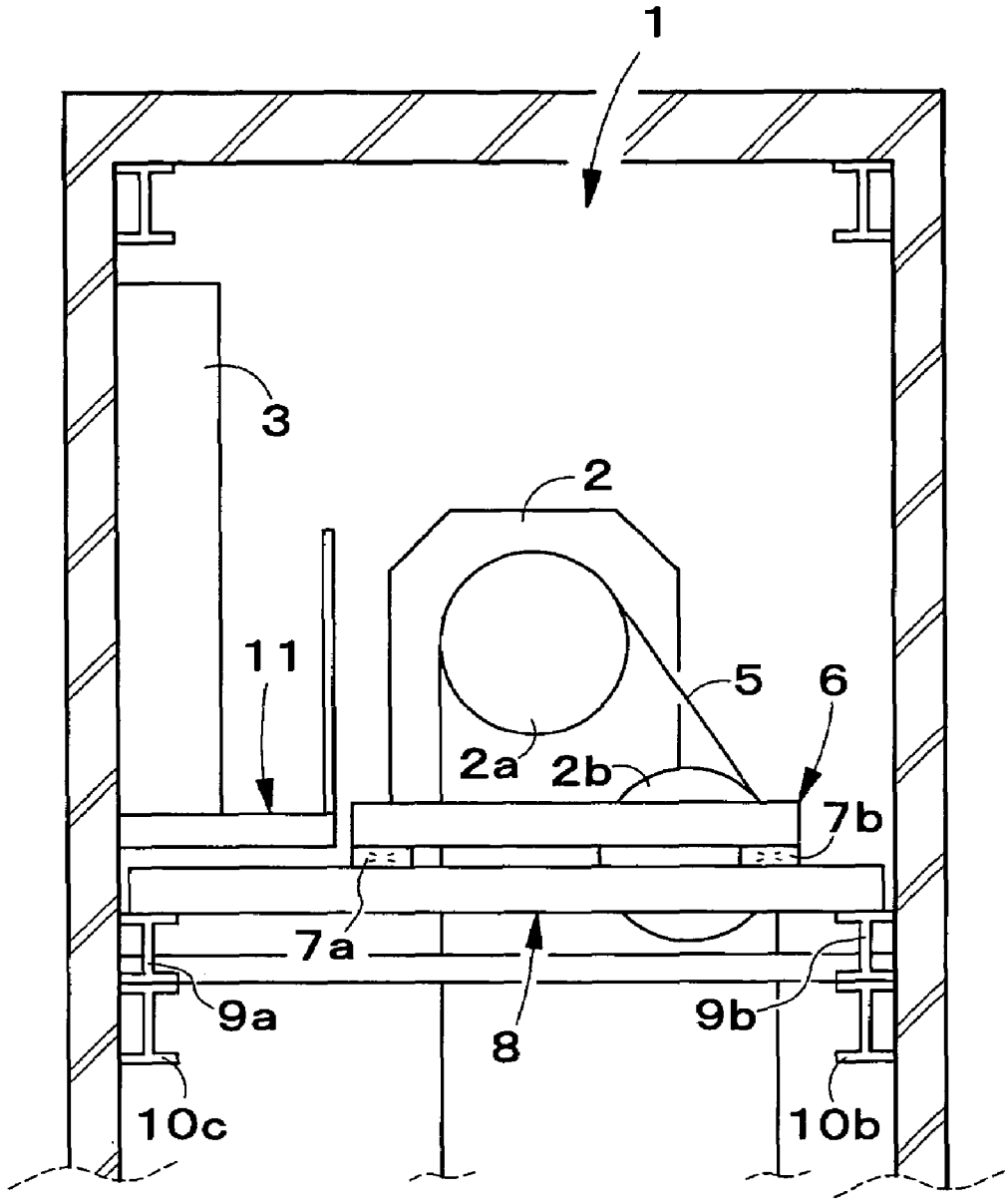
FIG. 26 is a side cross-sectional view of another machine room of a conventional elevator.

As in an elevator 430 of a third example shown in FIG. 24, when the control panel 48 is mounted on the supporting beam 61, a large operation space ranging from the front inner wall surface 35 to the rear inner wall surface 34 of the machine room can be secured in a center part of the floor 31 of the machine room 30.

Embodiments of the elevator according to the present invention were described in detail above. However, the present invention is not limited thereto, and it goes without saying that various changes and modifications are possible.

For example, in the respective above-described embodiments, the cage-side rope hitching portion 44 is arranged in a front part of the right inner wall surface 33 of the machine room 30. However, in accordance with an arrangement of the pair of right and left cage-side sheaves 25L and 25R, the cage-side hitching portion 44 may be disposed in a rear part of the right inner wall surface 33, that is, near the rear inner wall surface 34 of the machine room 30.

As apparent from the above description, according to the present invention, there is provided an elevator which has only an area equivalent to a horizontal cross-sectional area, but can have a sufficient operation space required for maintenance of an elevator hoist, a control panel, a speed governor, and so on.

Since a machine beam extending at full length in the back and forth direction in a machine room can be arranged along one of right and left inner wall surfaces of the machine room, the machine beam can be supported by building-side receiving beams respectively extending in the right and left direction along front and rear edges of the machine room. Therefore, no additional building-side receiving beam is needed for supporting the machine beam.

The invention claimed is:

1. An elevator system comprising:

a cage that is guided by a pair of right and left cage-side guide rails to vertically move in an elevator shaft;

a traction sheave that is arranged above one of the pair of right and left cage-side guide rails, and is rotated about a rotational axis extending in a front and back direction;

a driving apparatus that drives the traction sheave in rotation, and has an axis extending in the front and back direction:

a counterweight that is guided by a pair of front and rear counterweight-side guide rails below the traction sheave to vertically move in the elevator shaft;

a cage-side sheave disposed on the cage; and a hoist rope that is passed round the traction sheave, and has one end extending down apart from an inner wall surface of the elevator shaft to suspend the cage via the cage-side sheave and another end extending down along the inner wall surface of the elevator shaft suspending the counterweight; wherein a machine room disposed above the elevator shaft includes therein:

a machine beam that extends between building-side receiving beams in the front and back direction along one of a pair of right and left inner wall surfaces that extend opposite to each other in the front and back direction, the machine beam supporting the driving apparatus, the traction sheave, and a counterweight-side hitching portion for hitching the other end of the hoist rope on a side of the counterweight;

a cage-side hitching portion for hitching the one end of the hoist rope on a side of the cage, and a speed governor, which are arranged along the other of the pair of right and left inner wall surfaces; and a control panel for controlling the driving apparatus, which is arranged along the other inner wall surface, or a front inner wall surface extending in a right and left direction, perpendicular to the front and back direction, between the pair of right and left inner wall surfaces, wherein each of the machine beam the cage-side hitching portion, and the control panel is arranged around and outside of a unified operation space occupying a center part of the machine room, wherein said unified operation space is a space free of all equipment.

2. The elevator system according to claim 1, wherein both of the cage-side hitching portion and the speed governor are spaced apart from the front inner wall surface of the other inner wall surface.

3. The elevator system according to claim 1, wherein the cage-side hitching portion is disposed on a supporting beam extending along the other inner wall surface between the building-side receiving beams in the front and back direction.

4. The elevator system according to claim 1, wherein the cage-side hitching portion is disposed on a supporting beam extending in the right and left direction from the building-side receiving beams extending along the other inner wall surface in the front and back direction to the machine beam.

5. The elevator system according to claim 1, wherein the cage-side sheave includes a pair of right and left cage-side sheaves that are respectively arranged near right and left sidewalls of the cage.

6. The elevator system according to claim 1, wherein the driving apparatus has an axial dimension larger than a contour dimension thereof.

7. The elevator system according to claim 2, wherein the speed governor is disposed on a position higher than the cage-side hitching portion.

8. The elevator system according to claim 3, wherein the control panel is arranged on a position where the control panel is not interfered with by the supporting beam.

9. The elevator system according to claim 3, wherein the control panel is mounted on the supporting beam.

10. The elevator system according to claim 5, wherein the traction sheave is arranged such that at least a part of the traction sheave overlaps the cage when viewed vertically from above.

11. An elevator system comprising:

an elevator shaft in which a cage and a counterweight that are suspended by a hoist rope as a jig back are vertically moved;

a machine room that has a floor area equivalent to a cross-sectional area of the elevator shaft, and is arranged above the elevator shaft;

an elevator hoist that is arranged along a first inner wall surface of inner wall surfaces of the machine room, the first inner wall surface extending above one of right and left sidewalls of the cage in a front and back direction;

a rope hitching portion for hitching at least one of ends of the hoist rope, and arranged near a second inner wall surface of the inner wall surfaces of the machine room, the second inner wall surface extending above the other of the right and left sidewalls of the cage in the front and back direction; and a control panel that is arranged along a third inner wall surface or the second inner wall surface of the inner wall surfaces of the machine room, the third inner wall surface extending adjacent to the first inner wall surface in a right and left direction, perpendicular to the front and back direction, wherein each of the elevator hoist, the rope hitching portion, and the control panel is arranged around and outside of a unified operation space in a center part of the machine room, wherein said unified operation space is a space free of all equipment.

12. The elevator system according to claim 11, wherein the elevator hoist is supported by a first supporting beam extending along the first inner wall surface in the front and back direction between building-side receiving beams extending along the respective inner wall surfaces of the machine room.

13. The elevator system according to claim 11, wherein the rope hitching portion is supported by a third supporting beam extending along the third inner surface between one of the building-side receiving beams extending along the respective inner wall surfaces of the machine room and the first supporting beam.

14. The elevator system according claim 11 or 12, wherein the rope hitching portion is supported by a second supporting beam extending along the second inner wall surface in the front and back direction between the building-side receiving beams extending along the respective inner wall surfaces of the machine room.

15. The elevator system according to claim 14, wherein the control panel is supported by the second supporting beam.

16. The elevator system according to claim 13, wherein the control panel is supported by the third supporting beam.

17. An elevator system comprising:

a machine room that has a floor area equivalent to a cross-sectional area of an elevator shaft, and is arranged above the elevator shaft;

a cage that is guided by a pair of right and left cage-side guide rails to vertically move in the elevator shaft;

a counterweight that is guided by a pair of counterweight-side guide rails to vertically move in the elevator shaft on one side of right and left sidewalls of the cage;

a traction sheave that is rotated about a rotational axis extending in a front and back direction, and is arranged along a first inner wall surface of inner wall surfaces of the machine room, the first inner wall surface extending above the counterweight in the front and back direction;

a driving apparatus for driving the traction sheave in rotation, and arranged along the first inner wall surface in the machine room such that an axis of the driving apparatus extends in the front and back direction;

a cage-side sheave disposed on the cage;

a hoist rope that is passed round the traction sheave, and has one end extending down apart from an inner wall surface of the elevator shaft to suspend the cage via the cage-side sheave and another end extending down along the inner wall surface of the elevator shaft suspending the counterweight;

a cage-side rope hitching portion for hitching the one end of the hoist rope suspending the cage, and is arranged near a second inner wall surface of the inner wall surfaces of the machine room, the second inner wall surface extend opposite to the first inner wall surface in the front and back direction; and a control panel for controlling the driving apparatus, and arranged along a third inner wall surface adjacent to the first inner wall surface of the inner wall surfaces of the machine room, or the second inner wall surface, wherein each of the traction sheave, the cage-side rope hitching portion, and the control panel is arranged around and outside of a unified operation space in a center part of the machine room, wherein said unified operation space a space is free of all equipment.

18. The elevator system according to claim 17, wherein the driving apparatus is supported by a first supporting beam extending along the first inner wall surface in the front and back direction between building-side receiving beams arranged along a periphery of the machine room.

19. An elevator system comprising:

a machine room that has a floor area equivalent to a cross-sectional area of an elevator shaft, and is arranged above the elevator shaft;

a cage that is guided by a pair of right and left cage-side guide rails to vertically move in the elevator shaft;

a counterweight that is guided by a pair of counterweight-side guide rails on a side of a rear wall of the cage to vertically move in the elevator shaft;

a traction sheave that is rotated about a rotational axis extending in a front and back direction, and is arranged along a first inner wall surface of inner wall surfaces of the machine room, the first inner wall surface extending above one of right and left sidewalls of the cage in the front and back direction;

a driving apparatus for driving the traction sheave in rotation, that is arranged along the first inner wall surface in the machine room such that an axis of the driving apparatus extends in the front and back direction;

a cage-side sheave disposed on the cage;

a deflecting sheave arranged along an inner wall surface of the elevator shaft;

a hoist rope that is passed round the traction sheave, and has one end extending down apart from an inner wall surface of the elevator shaft to suspend the cage via the cage-side sheave and another end extending down along the inner wall surface of the elevator shaft extending to the counterweight by being guided by the deflecting sheave to suspend the counterweight;

a cage-side rope hitching portion for hitching the one end of the hoist rope suspending the cage, and arranged near a second inner wall surface of the inner wall surfaces of the machine room, the second inner wall surface extend opposite to the first inner wall surface in the front and back direction; and a control panel for controlling the driving apparatus, and arranged along a third inner wall surface adjacent to the first inner wall surface of the inner wall surfaces of the machine room, or the second inner wall surface, wherein each of the traction sheave, the cage-side rope hitching portion, and the control panel is arranged around and outside of a unified operation space in a center part of the machine room, wherein said unified operation space is a space free of all equipment.

20. The elevator system according to claim 17 or 19, wherein the driving apparatus has an axial dimension larger than a contour dimension thereof.

21. The elevator system according to claim 17 or 19, wherein the cage-side sheave is composed of a pair of right and left cage-side sheaves that are respectively arranged near right and left sidewalls of the cage.

22. The elevator system according to claim 17 or 19, wherein the traction sheave is arranged such that a part of the traction sheave overlaps the cage when viewed vertically from above.

23. The elevator system according to claim 17 or 19, wherein the cage-side rope hitching portion is supported by a second supporting beam extending along the second inner wall surface in the front and back direction between the building-side receiving beams.

24. The elevator system according to claim 17 or 19, wherein the cage-side rope hitching portion is supported by a third supporting beam extending in a right and left direction, perpendicular to the front and back direction, to be passed between the building-side receiving beams extending along the second inner wall surface in the front and back direction and a first supporting beam.

25. The elevator system according to claim 17 or 19, wherein the elevator further includes a speed governor for controlling a vertical movement speed of the cage, and arranged along the second inner wall surface in the machine room.

26. The elevator system according to claim 19, wherein the counterweight-side rope hitching portion for hitching the other end of the hoist rope suspending the counterweight is supported by the second supporting beam extending along the second inner wall surface in the front and back direction between the building-side receiving beams.

27. The elevator system according to claim 23, wherein the control panel is arranged on a position where the control panel is not interfered with by the supporting beams.

28. The elevator system according to claim 23, wherein the control panel is mounted on the supporting beams.

29. The elevator system according to claim 24, wherein the control panel is arranged on a position where the control panel is not interfered with by the supporting beams.

30. The elevator system to claim 24, wherein the control panel is mounted on the supporting beams.

31. The elevator system according to claim 26, wherein the control panel is arranged on a position where the control panel is not interfered with by the supporting beams.

32. The elevator system according to claim 26, wherein the control panel is mounted on the supporting beams.

33. The elevator system according to claim 25, wherein both of the cage-side rope hitching portion and the speed governor are arranged on a front portion of the second inner wall surface.

34. The elevator system according to claim 33, wherein the speed governor is disposed on a position higher than the cage-side rope hitching portion.

* * * * *